US010633861B2

(12) United States Patent
Brewer et al.

(10) Patent No.: US 10,633,861 B2
(45) Date of Patent: Apr. 28, 2020

(54) POST-TENSION TENDON POCKET FORMER WITH A RIBBED FORMWORK SECURING MECHANISM AND METHOD OF USE THEREOF

(71) Applicant: C&M Machines LLC, Rock Hill, SC (US)

(72) Inventors: Charles D. Brewer, York, SC (US); William B. Wilt, Tega Cay, SC (US)

(73) Assignee: C&M Machines LLC, Rock Hill, SC (US)

( * ) Notice: Subject to any disclaimer, the term of this patent is extended or adjusted under 35 U.S.C. 154(b) by 0 days.

(21) Appl. No.: 16/175,833

(22) Filed: Oct. 31, 2018

(65) Prior Publication Data

US 2019/0145103 A1 May 16, 2019

Related U.S. Application Data

(60) Provisional application No. 62/585,949, filed on Nov. 14, 2017.

(51) Int. Cl.
*E04C 5/08* (2006.01)
*E04C 5/12* (2006.01)

(52) U.S. Cl.
CPC ..... *E04C 5/12* (2013.01)

(58) Field of Classification Search
CPC . E04C 5/12; E04C 5/08; E04B 1/4157; E04B 1/40; E04B 1/4114; E04B 1/4135; B28B 23/005; B28B 23/12; B28B 23/0056; E04G 21/185; E04G 21/142; E04G 21/166; E04G 21/167; F16B 13/061
USPC ..... 52/223.13, 223.1, 699, 295, 704, 677, 52/688; 249/177, 63, 64, 175, 3, 4, 6, 7, 249/9
See application file for complete search history.

(56) References Cited

U.S. PATENT DOCUMENTS

| | | | | |
|---|---|---|---|---|
| 2,002,526 | A | 5/1935 | Colt | |
| 2,164,592 | A | 7/1939 | Pilj | |
| 3,367,620 | A | 2/1968 | Holt | |
| 3,503,584 | A | 3/1970 | Erhart et al. | |
| 3,685,783 | A | 8/1972 | Hilson | |
| 3,798,866 | A | 3/1974 | Werstein | |
| 4,412,407 | A | 11/1983 | Melfi et al. | |
| 4,773,198 | A * | 9/1988 | Reinhardt | E04C 5/122 52/223.13 |

(Continued)

*Primary Examiner* — Chi Q Nguyen
(74) *Attorney, Agent, or Firm* — Jeffrey C. Watson; Matthew L. Grell; Grell & Watson Patent Attornyeys LLC

(57) ABSTRACT

A post-tension tendon pocket former includes a pocket section, a formwork securing mechanism and an anchor securing mechanism. The pocket section is configured to create a pocket in an edge of concrete. The pocket section includes a first end and a second end. The formwork securing mechanism connected to the second end of the pocket section. The formwork securing mechanism is configured to secure the second end of the pocket section to a formwork. The anchor securing mechanism is connected to the first end of the pocket section. The anchor securing mechanism is configured to secure the first end of the pocket section to an anchor. The pocket section, formwork securing mechanism and anchor securing mechanism are integrally formed to create a one-piece pocket former. Whereby, the post-tension tendon pocket former is configured so secure and align the anchor to the formwork.

17 Claims, 17 Drawing Sheets

(56) References Cited

U.S. PATENT DOCUMENTS

| | | | | |
|---|---|---|---|---|
| 5,271,199 | A * | 12/1993 | Northern | E04C 5/12 24/122.6 |
| 5,415,510 | A * | 5/1995 | Funaki | E04G 17/0658 411/384 |
| 5,761,874 | A | 6/1998 | Hayakawa | |
| 6,393,781 | B1 * | 5/2002 | Sorkin | E04C 5/122 52/223.13 |
| 7,025,552 | B2 | 4/2006 | Grubert et al. | |
| 8,251,344 | B1 * | 8/2012 | Sorkin | E04C 5/122 249/177 |
| 8,950,137 | B2 | 2/2015 | Ciuperca | |
| 9,003,662 | B2 | 4/2015 | Burd et al. | |
| 9,303,399 | B2 | 4/2016 | Espinosa | |
| 9,388,841 | B2 | 7/2016 | Allmon et al. | |
| 9,394,706 | B2 | 7/2016 | Lin | |
| 2004/0148880 | A1 * | 8/2004 | Hayes | E04C 5/12 52/223.1 |
| 2006/0033003 | A1 * | 2/2006 | Watson | B28B 7/28 249/177 |
| 2013/0067849 | A1 * | 3/2013 | Espinosa | E04B 1/4121 52/699 |
| 2017/0204607 | A1 * | 7/2017 | Schmidt | E04C 5/122 |
| 2017/0275881 | A1 * | 9/2017 | Sorkin | E04C 5/12 |

* cited by examiner

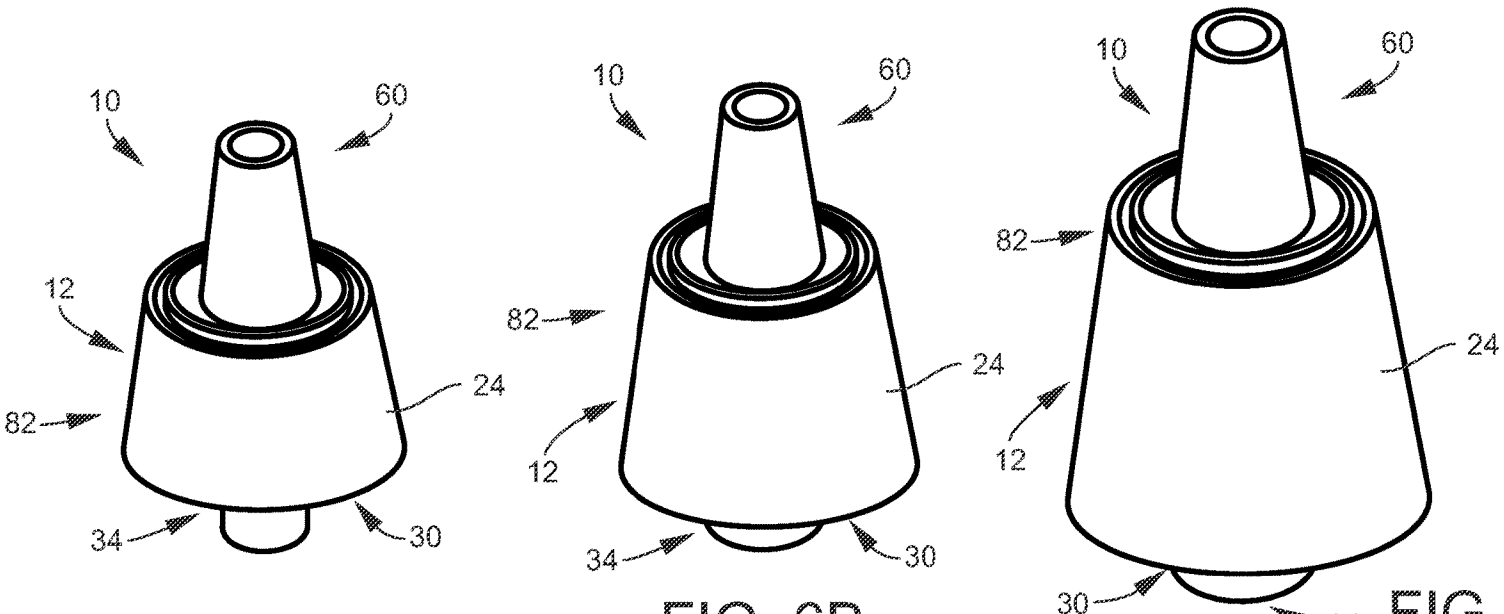
FIG. 6A
FIG. 6B
FIG. 6C
FIG. 6D
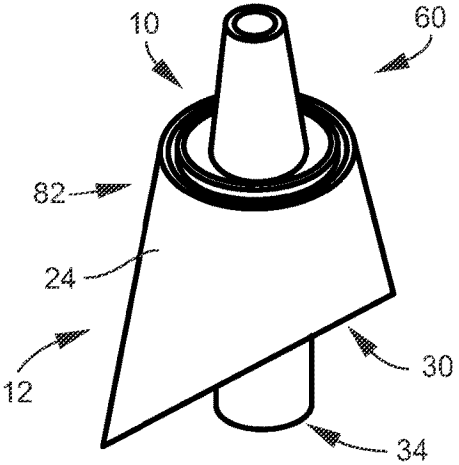
FIG. 6E
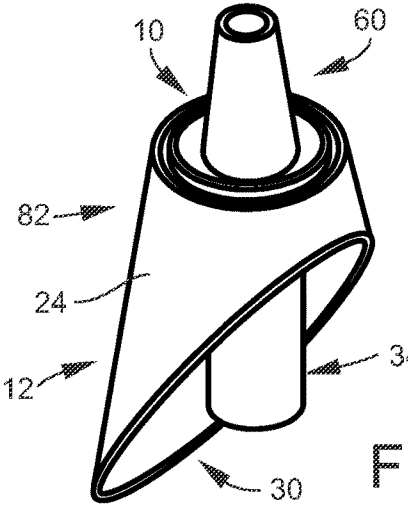
FIG. 6F

POST-TENSION TENDON POCKET FORMER WITH A RIBBED FORMWORK SECURING MECHANISM AND METHOD OF USE THEREOF

CROSS-REFERENCE TO RELATED APPLICATIONS

To the full extent permitted by law, the present United States Non-provisional Patent Application hereby claims priority to and the full benefit of, U.S. Provisional Application No. 62/585,949, filed on Nov. 14, 2017, entitled "Tendon Pocket Former with a Ribbed Plywood Securing Mechanism", which is incorporated by reference herein in its entirety.

FIELD OF THE DISCLOSURE

The present disclosure relates to post-tension concrete structures and means and methods for the installation of the post-tension tendons or cables used therein. More specifically, the present disclosure is directed to usage of a tendon pocket former with a ribbed formwork securing mechanism that secures, and aligns the anchor in one step to the formwork, and a method of use thereof.

BACKGROUND

Post-tensioned concrete is a variant of pre-stressed concrete where the tendons or cables are tensioned after the surrounding concrete structure has been cast. Construction of post-tensioned slabs on grade is very similar to using reinforcing steel, except for the tensioning step. Cables are arranged as indicated by the engineer and typically chaired to run through the center of the slab. For residential construction, tendons at 48 inches on center are common. Commercial foundations will have much more steel. Tendons can be easily routed around obstructions.

A residential post-tensioned concrete slab will typically be 8 inches thick and use 3000 psi concrete. Once the concrete has gained strength to 2000 psi, typically within the 3 to 10 days recommended by PTI, the tendons are stressed.

Tendons today are seven high-strength steel wires wound together and placed inside a plastic duct. At each end of the tendons, a post tension anchor is positioned for securing the cable or tendon and to distribute tensile force into the concrete by applying tension to the tendons. One end of the cable tendons requires a pocket to be formed so that stressing equipment can access the anchor for force application and wedge seating operations. When the strands are stressed, the tendons will stretch—about 4 inches for a 50 foot strand—to apply 33,000 pounds of load. Stressing of post-tension tendons is a dangerous job that requires a lot of skill and is typically only done by qualified workers. After stressing, the tendon is cut off and a grease cap is installed in encapsulated systems to create a watertight seal and then the pockets are filled with non-shrink grout to protect them from corrosion.

Larger structural concrete members may also be post-tensioned, especially in bridges and floors and beams in parking structures. The process is very similar to that used for slabs, except on a bigger scale. One interesting difference is that the tendons will often be "draped" so that they are low at the midpoint of a beam and high at the support, which places the steel at the point of highest tension where it can keep the concrete held together tightly. In multi-strand applications, with structural members the duct is often grouted full following stressing to bond the strand to the concrete along its entire length. When the duct is fully grouted, the combined duct, grout and tendons are called bonded tendons. On the other hand, in mono-strand applications, the duct is normally not grouted. Unbonded tendons, like those used in residential slabs and commercial low rise buildings, remain free to move within the duct and are protected from corrosion by grease.

Post-tension tendon placement and stressing is usually done by companies with certified workers who specialize in this work. Current pocket formers for post tension cables only provide a small alignment ring for the anchor to plywood connection. This requires the user to hold the anchor in alignment and secure it using nails or screws. Holding the anchor, nail and a hammer is difficult in open situations but even harder in tight spaces, such as beams and columns with rebar. Others have used a threaded mandrel and nut that secures the anchor to the plywood formwork, but this still requires two people in areas where the opposing side of the formwork is not easily accessible. The mandrel approach also requires multiple pieces which makes it cumbersome.

As such, currently the pocket former and anchor assembly require nails or screws to hold the assembly in place during tendon installation and concrete placement. The installation of nails into the plywood is difficult because of rigidity, and having to hold everything at one time. In addition, the use of nails only typically results in some back-outs of the assembly (ring shank nails may be used to limit this possibility), which takes constant supervision and time to deal with. Screws make this easier, but can make removal of the forms much more difficult, as the form has to be ripped off the head of the screws due to the head of the screws being buried in the concrete (i.e. the screws can not be unscrewed). As a result, both screws and nails are difficult to install and require extensions and creative methods when rebar is installed before the tendons are installed. Therefore, there is clearly a need to provide a means and method for faster and easier installation of the pocket former and anchor assembly with post-tension cables.

The instant disclosure is designed to address at least certain aspects of the problems or needs discussed above by providing a tendon pocket former with a ribbed formwork securing mechanism and a method of use thereof.

SUMMARY

Accordingly, in one aspect, the present disclosure embraces a post-tension tendon pocket former. The post-tension tendon pocket former may include a pocket section, a formwork securing mechanism and an anchor securing mechanism. The pocket section may be configured to create a pocket in an edge of concrete. The pocket section may include a first end and a second end. The formwork securing mechanism may be connected to the second end of the pocket section. The formwork securing mechanism may be configured to secure the second end of the pocket section to a formwork. The anchor securing mechanism may be connected to the first end of the pocket section. The anchor securing mechanism may be configured to secure the first end of the pocket section to an anchor.

In select embodiments of the instant post-tension tendon pocket former, the pocket section, formwork securing mechanism and anchor securing mechanism may be integrally formed. As such, the integral formation of the components of the post-tension tendon pocket former may create a one-piece pocket former.

One feature of the instant post-tension tendon pocket former may be that it can be configured so secure and align the anchor to the formwork.

In select embodiments of the post-tension tendon pocket former, the formwork securing mechanism may include an alignment shaft with formwork ribs. The alignment shaft with the formwork ribs may be configured to be inserted into a hole in the formwork. In select embodiments, the formwork ribs on the alignment shaft of the formwork securing mechanism may be angled towards the second end of the pocket section. Whereby the formwork ribs may be configured to prevent removal or backing out of the alignment shaft once inserted into the hole in the formwork. In other select embodiments, the formwork ribs on the alignment shaft of the formwork securing mechanism may be tapered. Whereby, the tapered formwork ribs may slightly deflect during insertion of the alignment shaft into the hole in the formwork. The alignment shaft may have an extended length that extends from the second end of the pocket section to a distal end. In select embodiments, the extended length of the alignment shaft may be sized to extend at least a thickness of the formwork. Whereby when the alignment shaft of the formwork securing mechanism is inserted through the hole in the formwork where the second end of the pocket section is aligned with an inner surface of the formwork, the distal end of the alignment shaft and at least one of the formwork ribs on the alignment shaft may extend beyond an outer surface of the formwork. The formwork securing mechanism may be configured to secure the second end of the pocket section to any type of formwork, including, but not limited to, a plywood formwork or a medium-density fiberboard formwork.

In select embodiments of the instant post-tension tendon pocket former, the anchor securing mechanism may include a small tapered section. The small tapered section may be connected to the first end of the pocket section. The small tapered section may be configured to be inserted into and secured in a tapered receiver of the anchor. The small tapered section may include a first set of anchor ribs on a proximal end of the small tapered section. In select embodiments, the first set of anchor ribs of the small tapered section of the anchor securing mechanism may be angled towards the first end of the pocket section, whereby the first set of anchor ribs are configured to prevent removal or backing out of the small tapered section from tapered receiver of the anchor. In other select embodiments, the first set of anchored ribs may be tapered, whereby, the first set of anchor ribs slightly deflect during insertion of the small tapered section into the tapered receiver of the anchor.

In other select embodiments of the instant post-tension tendon pocket former, the anchor securing mechanism may include a slight tapered section. The slight tapered section may be connected to the first end of the pocket section. The slight tapered section may be configured to seal to an internal anchor assembly seal area of the anchor. A second set of anchor ribs may be included on the slight tapered section. In select embodiments, the second set of anchor ribs of the slight tapered section of the anchor securing mechanism may be angled towards the first end of the pocket section, whereby the second set of anchor ribs are configured to prevent removal or backing out of the slight tapered section from the internal anchor assembly seal area of the anchor. In other select embodiments, the second set of anchor ribs of the slight tapered section of the anchor securing mechanism may be tapered, whereby, the second set of anchor ribs may slightly deflect during insertion of the slight tapered section into the internal anchor assembly seal area of the anchor.

In another embodiment of the instant post-tension tendon pocket former, the anchor securing mechanism may include a slight tapered section and a small tapered section. The slight tapered section may be connected to the first end of the pocket section. The slight tapered section may be configured to seal to an internal anchor assembly seal area of the anchor. The small tapered section may be connected to the slight tapered section. The small tapered section may be configured to be inserted into and secured in a tapered receiver of the anchor. The small tapered section may include a first set of anchor ribs on a proximal end of the small tapered section. A second set of anchor ribs may be included on the slight tapered section. In select embodiments, the first set of anchor ribs of the small tapered section of the anchor securing mechanism may be angled towards the first end of the pocket section, whereby the first set of anchor ribs are configured to prevent removal or backing out of the small tapered section from tapered receiver of the anchor. In other select embodiments, the first set of anchored ribs may be tapered, whereby, the first set of anchor ribs slightly deflect during insertion of the small tapered section into the tapered receiver of the anchor. In select embodiments, the second set of anchor ribs of the slight tapered section of the anchor securing mechanism may be angled towards the first end of the pocket section, whereby the second set of anchor ribs are configured to prevent removal or backing out of the slight tapered section from the internal anchor assembly seal area of the anchor. In other select embodiments, the second set of anchor ribs of the slight tapered section of the anchor securing mechanism may be tapered, whereby, the second set of anchor ribs may slightly deflect during insertion of the slight tapered section into the internal anchor assembly seal area of the anchor.

In other select embodiments of the instant post-tension tendon pocket former, the pocket section may have a large tapered section. The large tapered section may be between the first end and the second end of the pocket section. The large tapered section may be configured to create the pocket in the edge of the concrete. The pocket created with the large tapered section may be configured to allow tension to be applied to a tendon connected to the anchor. In select embodiments, the large tapered section could also be increased or decreased in diameter and could be made in multiple shapes to allow cut-off tool access. In select embodiments, the large tapered section of the pocket section may include a hollow interior supported by a plurality of spokes. The hollow interior of the large tapered section of the pocket section may include any number of spokes, including, but not limited to, five spokes for supporting the hollow interior.

In another aspect, the instant disclosure embraces a method of creating pockets in concrete for post-tension tendons. The instant method of creating pockets in concrete for post-tension tendons generally may include the step of providing the post-tension tendon pocket former in any of the various embodiments shown and/or described herein. As such, the provided post-tension tendon pocket former may generally include a pocket section, a formwork securing mechanism and an anchor securing mechanism. The pocket section may be configured to create a pocket in an edge of concrete. The pocket section may include a first end and a second end. The formwork securing mechanism may be connected to the second end of the pocket section. The formwork securing mechanism may be configured to secure the second end of the pocket section to a formwork. The anchor securing mechanism may be connected to the first end of the pocket section. The anchor securing mechanism may be configured to secure the first end of the pocket section to an anchor. Wherein, using this provided post-tension pocket former, the method of creating pockets in concrete for post-tension tendons may also include forming a pocket in the edge of the concrete with the provided post-tension tendon pocket former.

In select embodiments of the instant method of creating pockets in concrete for post-tension tendons, the step of forming a pocket in the edge of the concrete with the provided post-tension tendon pocket former may also include: drilling at least one hole in the formwork at a desired position; attaching the formwork securing mechanism to the hole drilled in the formwork; attaching the anchor to the anchor securing mechanism; positioning the formwork in the desired location for the concrete; attaching a tendon to the anchor; pouring the concrete; waiting for the concrete to set; and removing the formwork from the edge of the concrete. Whereby, the post-tension pocket former remains attached to the formwork and pulls away from the anchor thereby creating the pocket in the edge of the concrete configured to allow tension to be applied to the tendon connected to the anchor, the cable to be cut, grease cap/corrosion protection installed, grout applied, the like, etc.

The foregoing illustrative summary, as well as other exemplary objectives and/or advantages of the disclosure, and the manner in which the same are accomplished, are further explained within the following detailed description and its accompanying drawings.

BRIEF DESCRIPTION OF THE DRAWINGS

The present disclosure will be better understood by reading the Detailed Description with reference to the accompanying drawings, which are not necessarily drawn to scale, and in which like reference numerals denote similar structure and refer to like elements throughout, and in which:

FIG. 6A is a top proximal end view of the post-tension tendon pocket former according to select embodiments of the instant disclosure with a small sized large tapered section;

FIG. 6B is a top proximal end view of the post-tension tendon pocket former according to select embodiments of the instant disclosure with a medium sized large tapered section;

FIG. 6C is a top proximal end view of the post-tension tendon pocket former according to select embodiments of the instant disclosure with a large sized large tapered section;

FIG. 6D is a top proximal end view of the post-tension tendon pocket former according to select embodiments of the instant disclosure without large tapered section;

FIG. 6E is a top proximal end view of the post-tension tendon pocket former according to select embodiments of the instant disclosure with a small sized angled large tapered section;

FIG. 6F is a top proximal end view of the post-tension tendon pocket former according to select embodiments of the instant disclosure with a large sized angled large tapered section;

Figure 1:
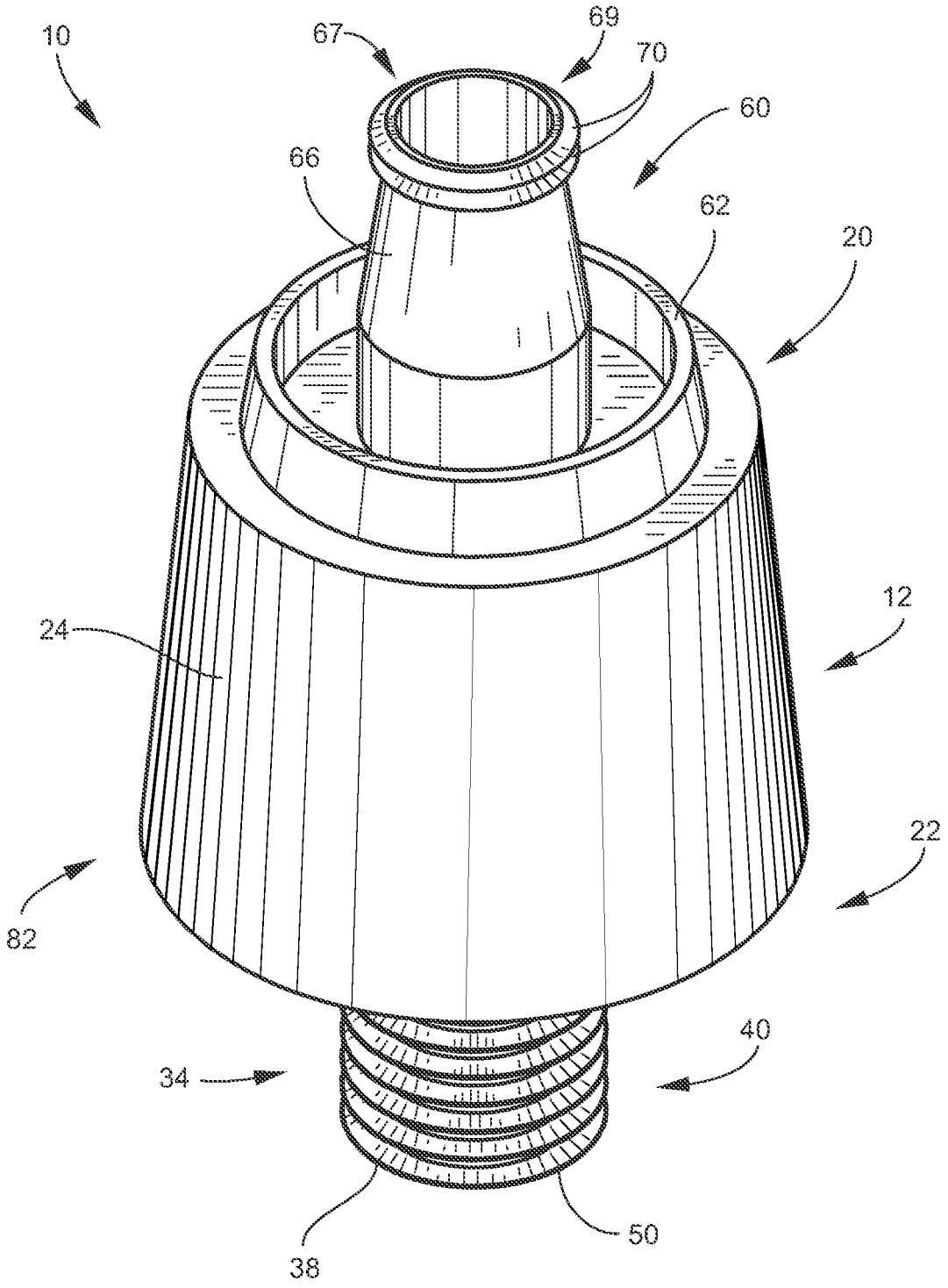
FIG. 1 is a perspective proximal end view of the post-tension tendon pocket former according to select embodiments of the instant disclosure.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

Referring now to FIGS. 1-17, in describing the exemplary embodiments of the present disclosure, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples and are merely examples among other possible examples.

Referring now to FIGS. 1-16, in a possibly preferred embodiment, the present disclosure overcomes the above-mentioned disadvantages and meets the recognized need for such an apparatus or method by providing of post-tension tendon pocket former 10. Post-tension pocket former 10 may be for providing a one piece pocket former that secures, and aligns anchor 28 in one step to the formwork 36, like plywood formwork 56. As such, one feature of post-tension tendon pocket former 10 may be that it can be configured so secure and align anchor 28 to formwork 36, as shown in FIGS. 7 and 9-16. Post-tension pocket former 10 may designed to make it easy for a single man installation in a fraction of the time. Post-tension pocket former 10 may generally include pocket section 12, formwork securing mechanism 34 and anchor securing mechanism 60. Formwork securing mechanism 34 may be connected to second end 22 of pocket section 12. As such, formwork securing mechanism 34 may be configured to secure second end 22 of pocket section 12 to formwork 36. Anchor securing mechanism 60 may be connected to first end 20 of pocket section 12. Anchor securing mechanism 60 may be configured to secure first end 20 of pocket section 12 to anchor 28. These parts and their components and function will be described in greater detail below.

In select embodiments of post-tension tendon pocket former 10, pocket section 12, formwork securing mechanism 34 and anchor securing mechanism 60 may be integrally formed. As such, the integral formation of the components of post-tension tendon pocket former 10 may create one-piece pocket former 82, as shown in the Figures. Specifically, referring to FIG. 4, as shown in this cross-section view of pocket former 10, all components are created or formed together. As examples, and clearly not limited thereto, post-tension tendon pocket former may be made out of high density plastic, which can be injection molded, 3D printed, or cast. In an alternative embodiment, one could make a mandrel with the ribs and make the disclosure 2 pieces.

Figure 2:
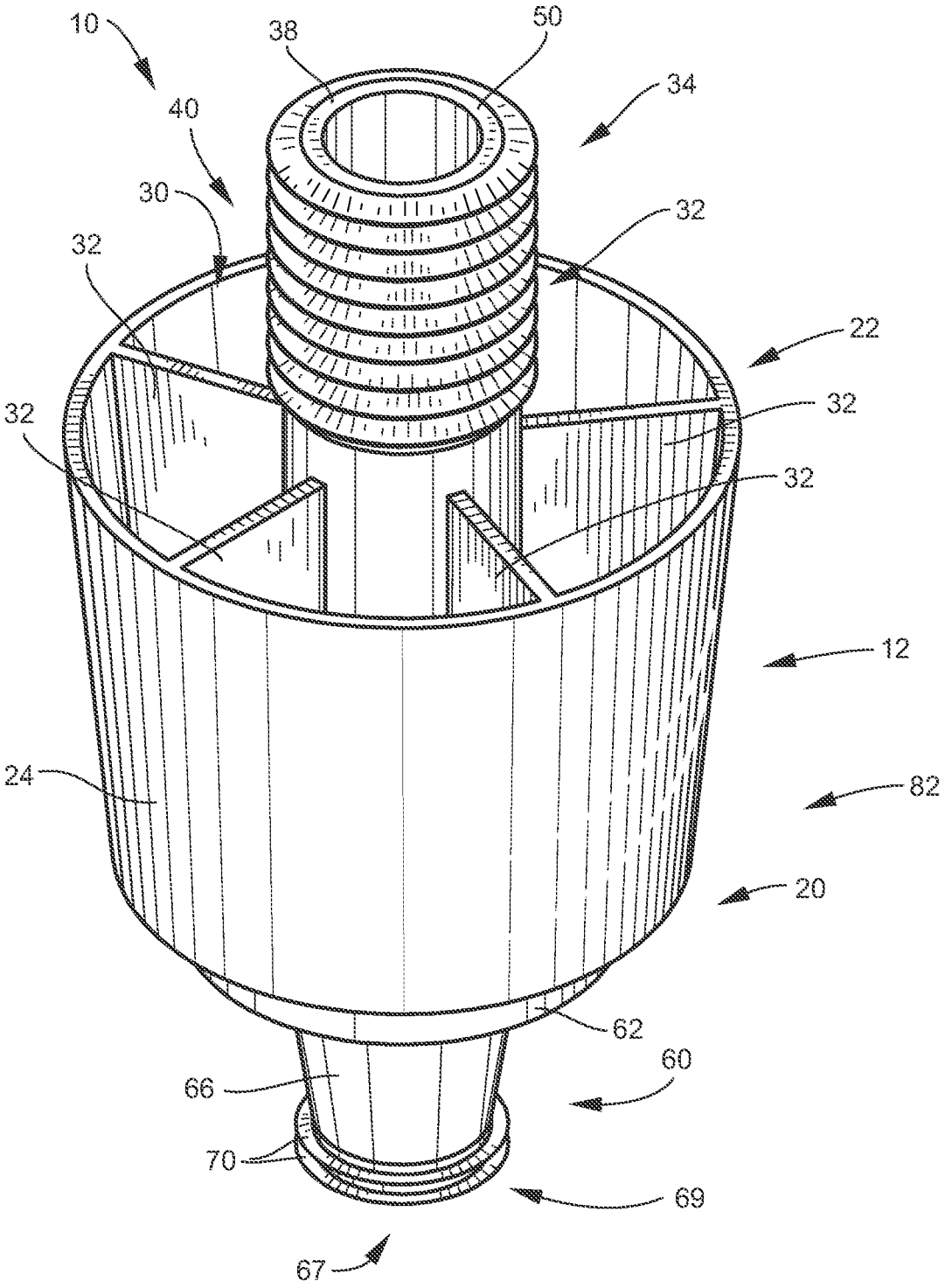
FIG. 2 is a perspective distal end view of the post-tension tendon pocket former of FIG. 1.
Figure 7:
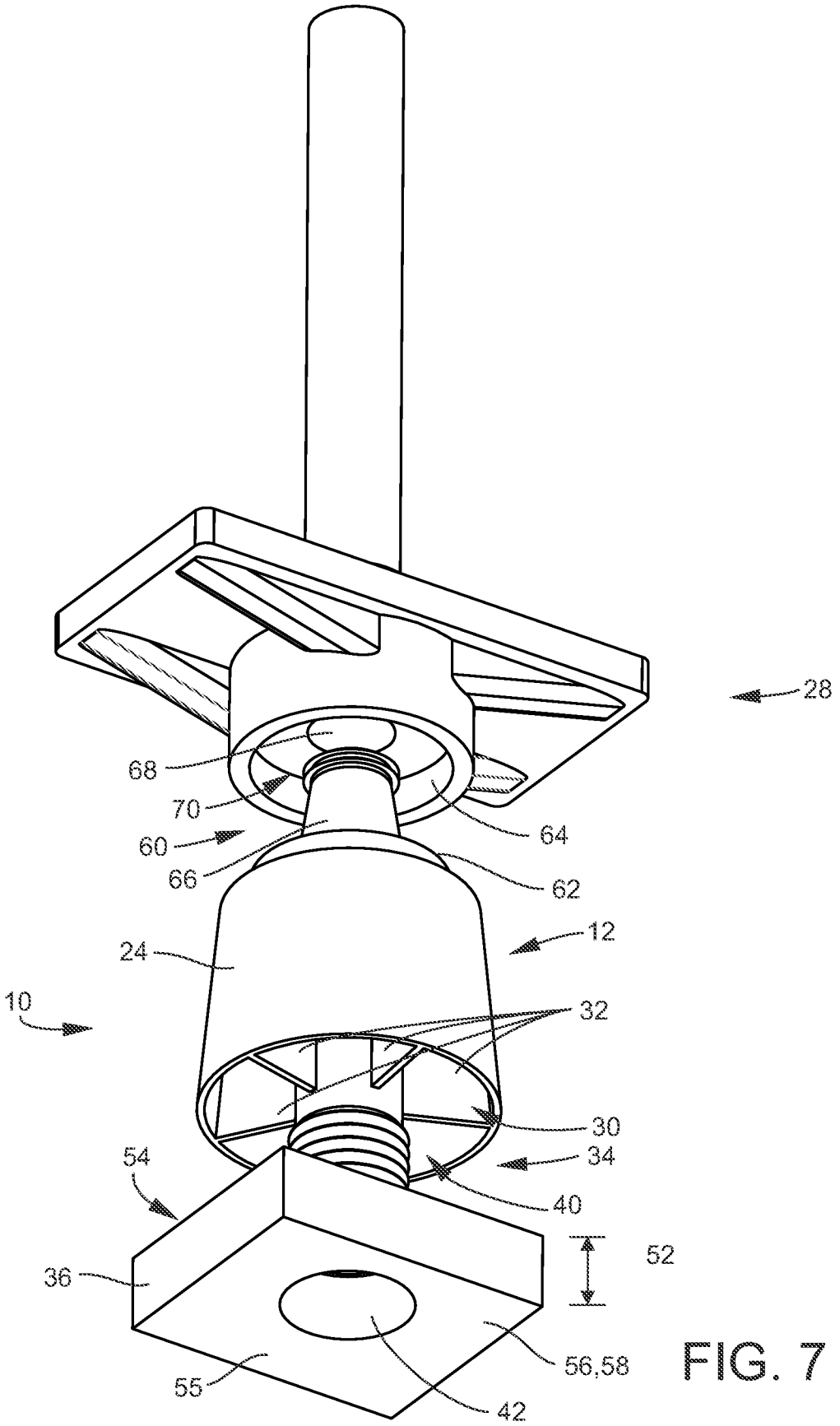
FIG. 7 is a perspective disassembled environmental view of the post-tension tendon pocket former with the formwork securing mechanism disassembled from the hole in the formwork and the anchor securing mechanism disassembled from the anchor.
Figure 8:
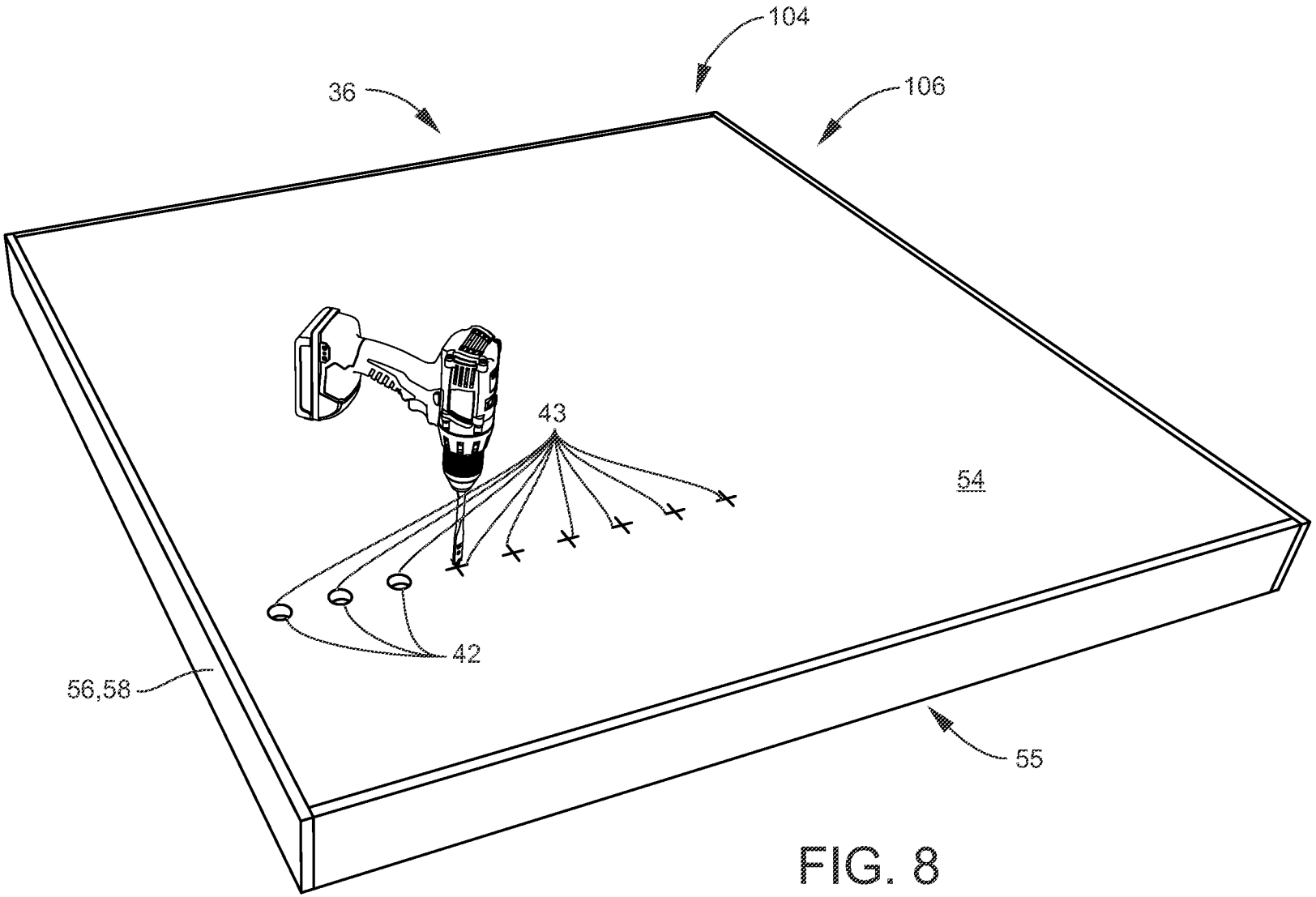
FIG. 8 is a perspective environmental view of drilling the holes in the formwork in a desired location according to select embodiments of the instant method of creating pockets in concrete for post-tension tendons.
Figure 9:
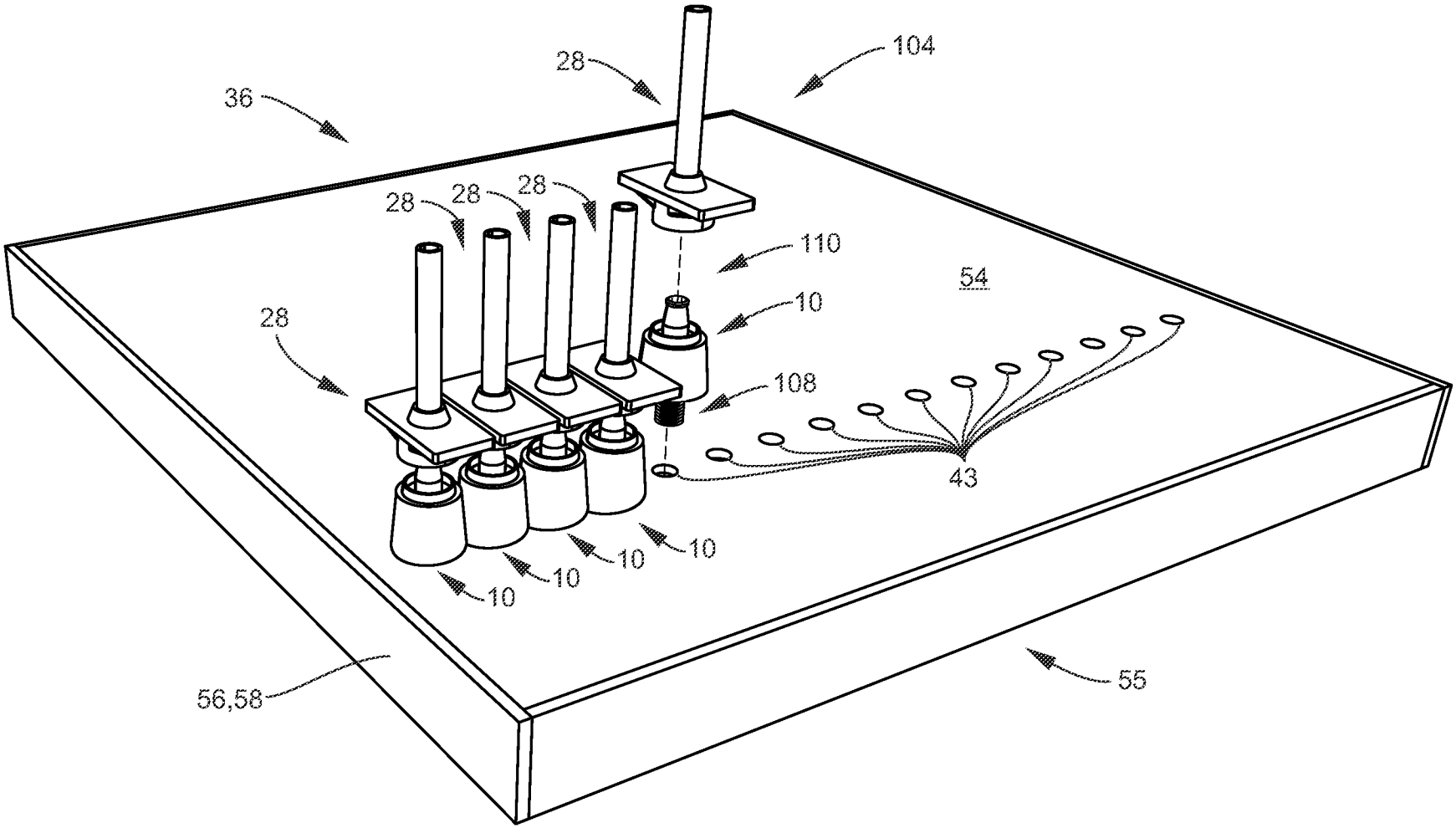
FIG. 9 is a perspective environmental view of select embodiments of attaching the formwork securing mechanism to the hole drilled in the formwork and attaching the anchor to the anchor securing mechanism according to select embodiments of the instant method of creating pockets in concrete for post-tension tendons.
Figure 10:
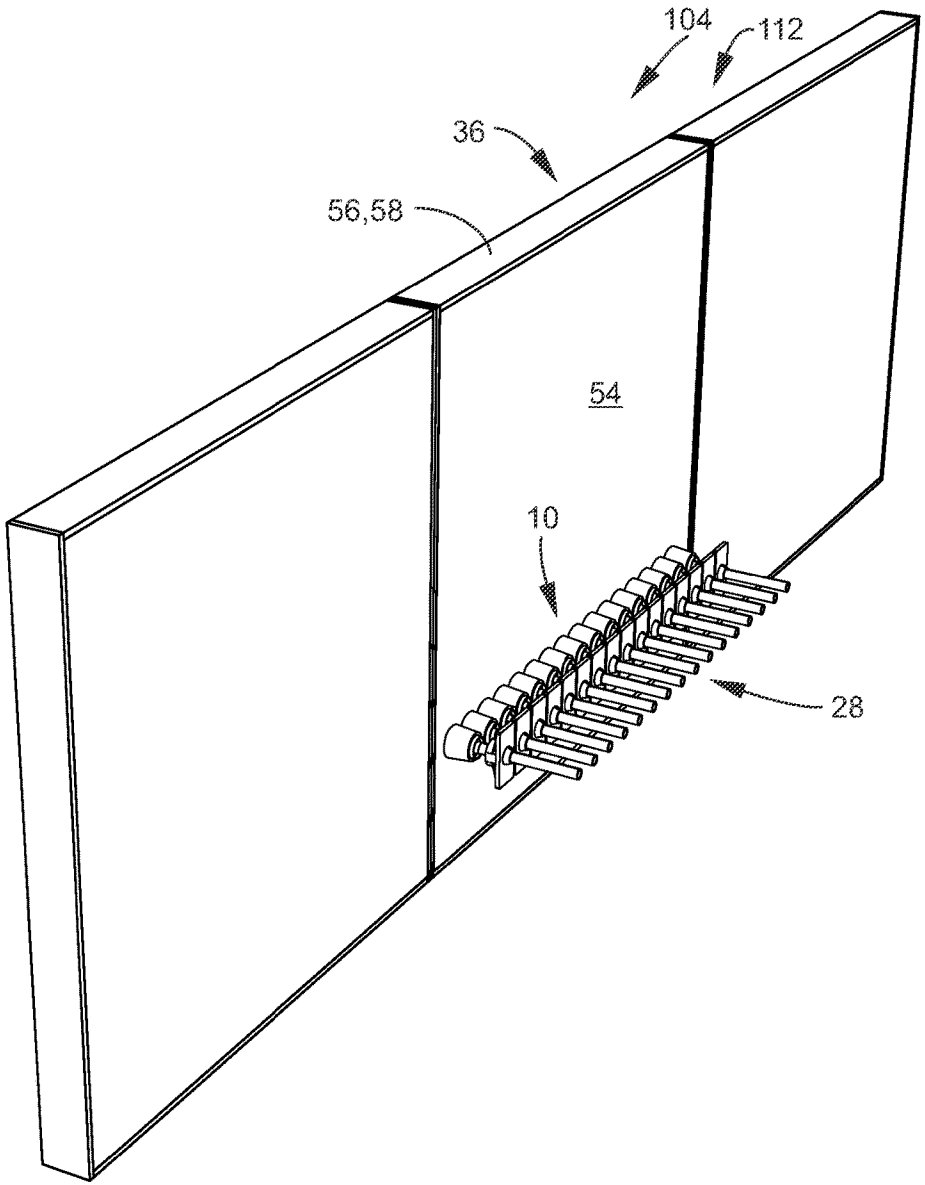
FIG. 10 is an inner perspective environmental view of select embodiments of positioning the formwork in the desired location for the concrete according to select embodiments of the instant method of creating pockets in concrete for post-tension tendons.

Pocket section 12 may be included with post-tension pocket former 10. Pocket section 12 may be for providing the space or material sized to create pocket 14 in edge 16 of concrete 18. As such, pocket section 12 may be configured to create pocket 14 in edge 16 of concrete 18. Pocket section 12 may include first end 20 and second end 22. First end 20 may be adjacent or connected to formwork securing mechanism 34. As such, first end 20 may provide the means or material for attaching formwork securing mechanism 34 to pocket section 12. Second end 22 may be adjacent or connected to anchor securing mechanism 60. As such, second end 22 may provide the means or material for attaching anchor securing mechanism 60 to pocket section 12. In select embodiments, pocket section 12 may have large tapered section 24. Large tapered section 24 may be between first end 20 and second end 22 of pocket section 12. Large tapered section 24 may be configured to create pocket 14 in edge 16 of concrete 18. Pocket 14 created with large tapered section 24 may be configured to allow tension to be applied to tendon 26 connected to anchor 28. In select embodiments, large tapered section 24 could also be increased or decreased in diameter and could be made in multiple shapes to allow cut-off tool access. See FIGS. 6A-6F. Large tapered section 24 may be any desired size, shape and configuration for creating any desired size, shape and configuration of pocket 14 in edge 16 of concrete 18. Referring now to FIGS. 6A-6F, various embodiments of shapes and sizes of large tapered section 24 are shown. However, the disclosure is not so limited, and these various embodiments of the shapes and sizes of large tapered section 24 are provided merely for examples. Referring specifically to FIG. 6A, a small sized large tapered section 24 is shown. Referring specifically to FIG. 6B a medium sized large tapered section 24 is shown. Referring specifically to FIG. 6C, a large sized large tapered section 24 is shown. Referring specifically to FIG. 6D, an embodiment with no large tapered section is shown. Referring specifically to FIG. 6E, a small sized angled large tapered section 24 is shown, which may be used for creating smaller pockets 14 in angled edges 16 of concrete 18. Finally, referring specifically to FIG. 6F, a large sized angled large tapered section 24 is shown, which may be used for creating larger pockets 14 in angled edges 16 of concrete 18. In select embodiments, large tapered section 24 of pocket section 12 may include hollow interior 30. Hollow interior 30 may be supported or reinforced under the weight of the poured concrete 18 by a plurality of spokes 32. Hollow interior of large tapered section 24 of pocket section 12 may include any number of spokes 32, including, but not limited to, five spokes 32 for supporting hollow interior 30, as best shown in FIGS. 2 and 7.

Figure 11:
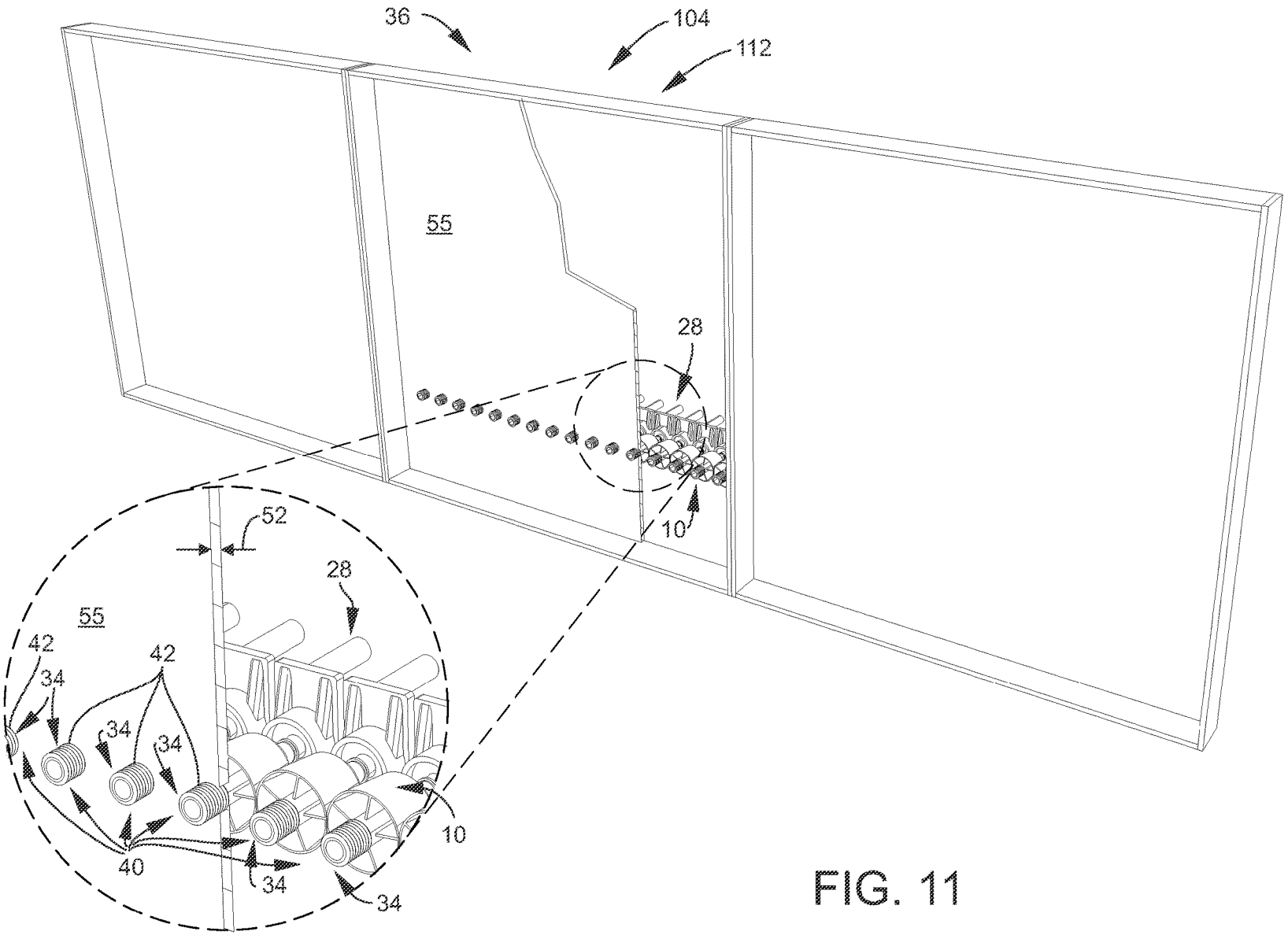
FIG. 11 is an outer perspective view of the formwork from FIG. 10 with a zoomed in portion of a partially broken away section of the formwork.
Figure 12:
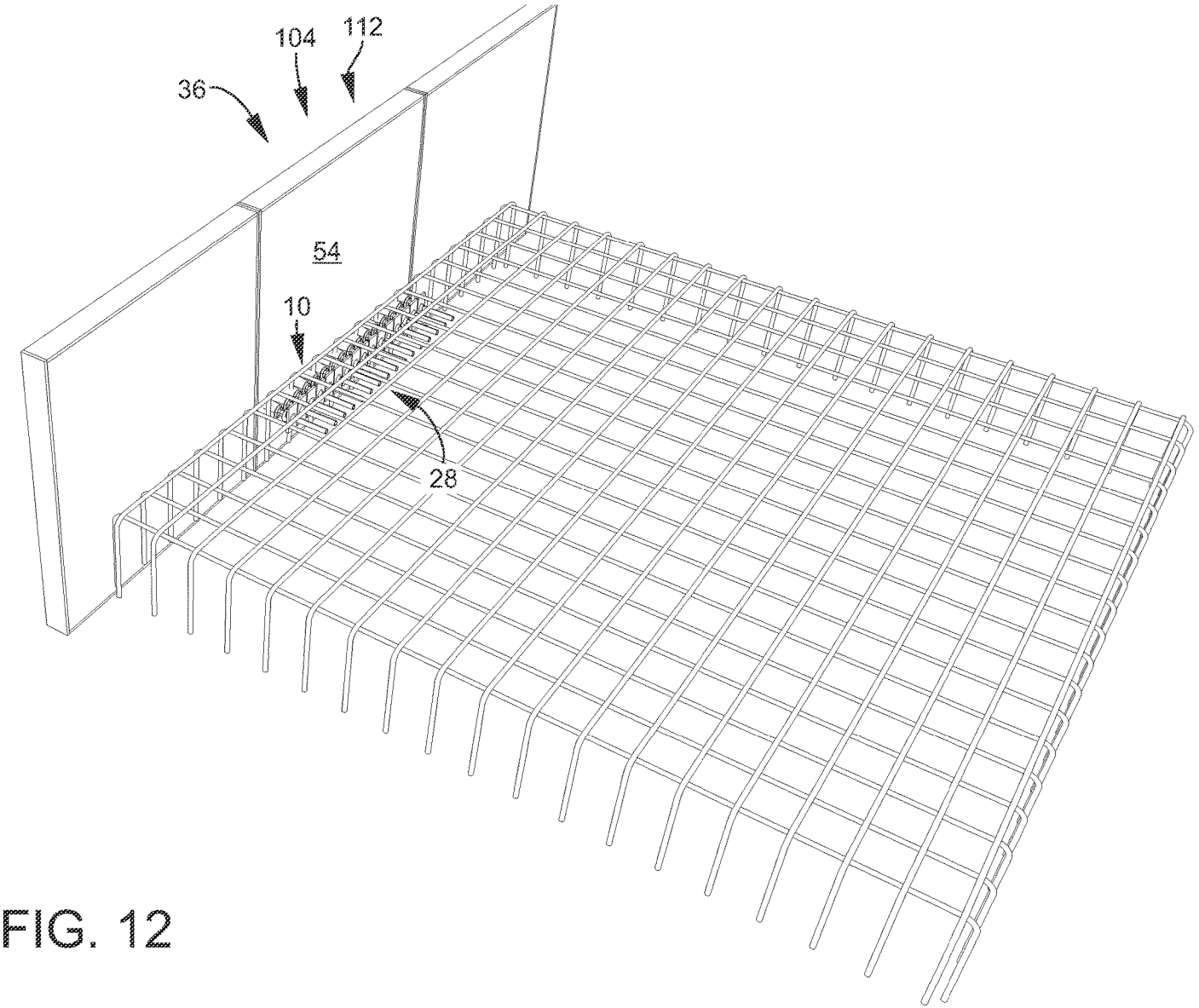
FIG. 12 is an inner perspective environmental view of select embodiments of positioning the formwork in the desired location for the concrete according to select embodiments of the instant method of creating pockets in concrete for post-tension tendons with rebar added for support in the concrete.
Figure 13:
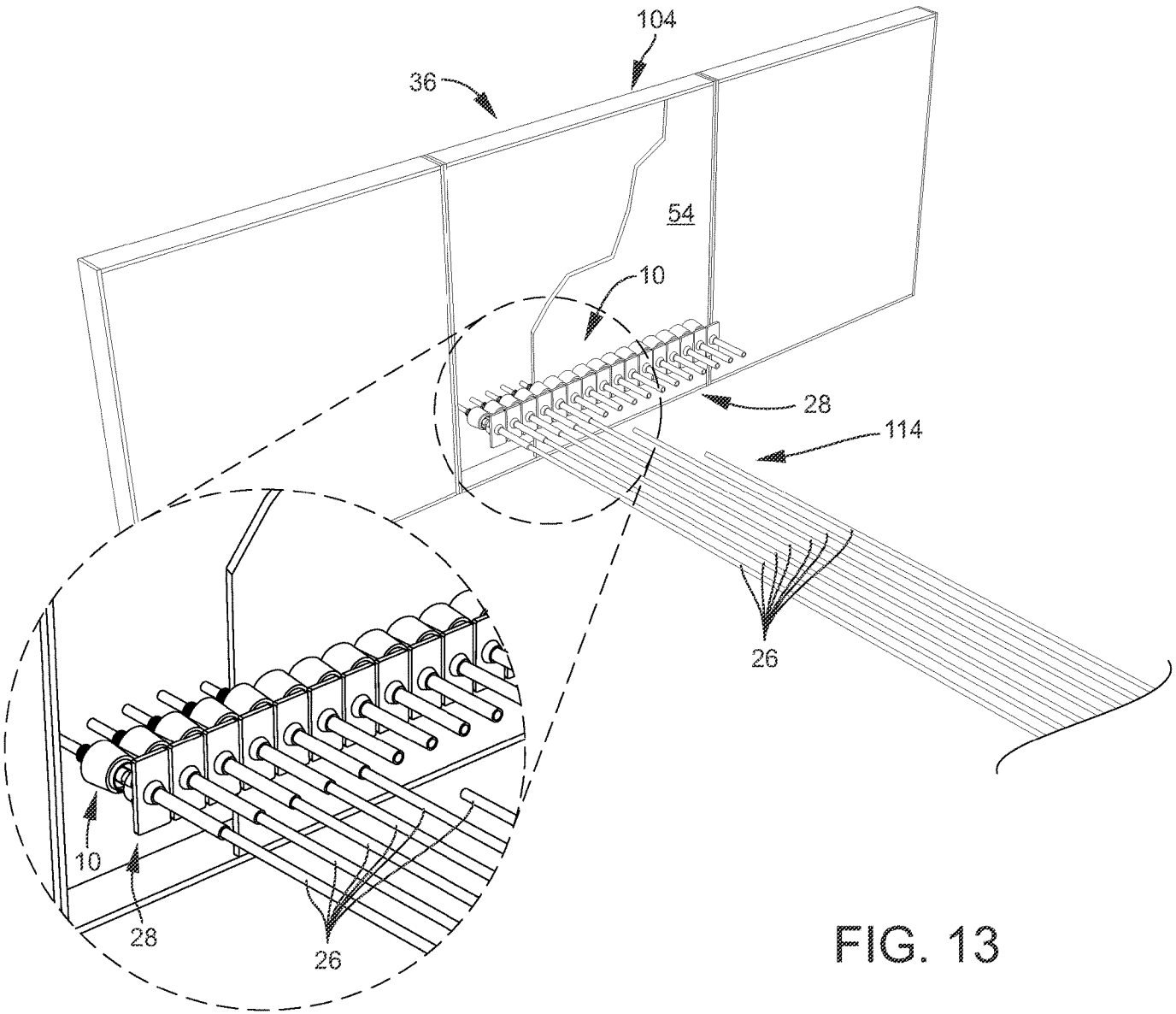
FIG. 13 is an inner perspective environmental view of select embodiments of attaching the tendons to the anchors according to select embodiments of the instant method of creating pockets in concrete for post-tension tendons with rebar added for support in the concrete.
Figure 14:
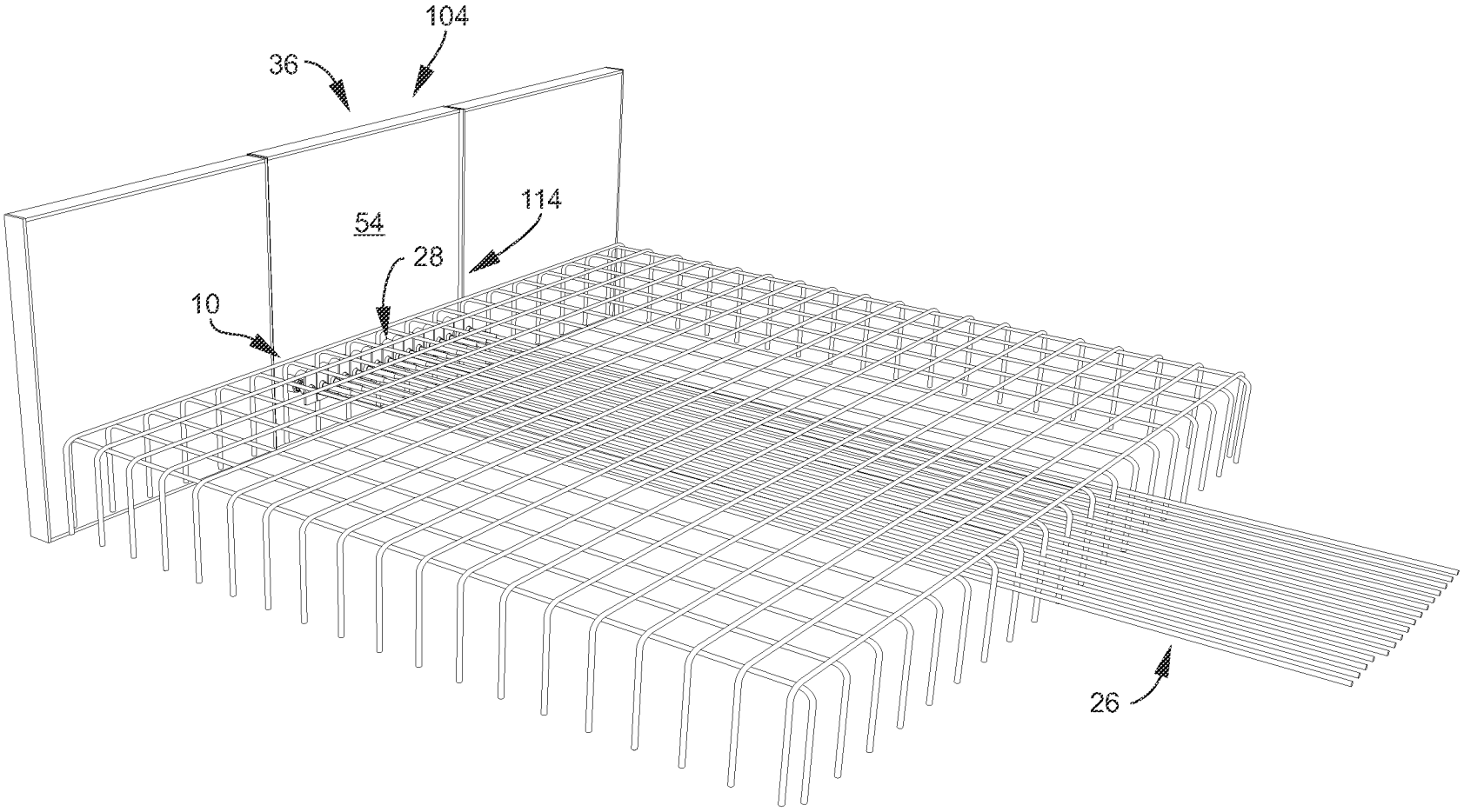
FIG. 14 is an inner perspective environmental view of select embodiments of positioning the formwork in the desired location for the concrete according to select embodiments of the instant method of creating pockets in concrete for post-tension tendons with the tendons connected to the anchors and rebar added for support in the concrete.
Figure 15:
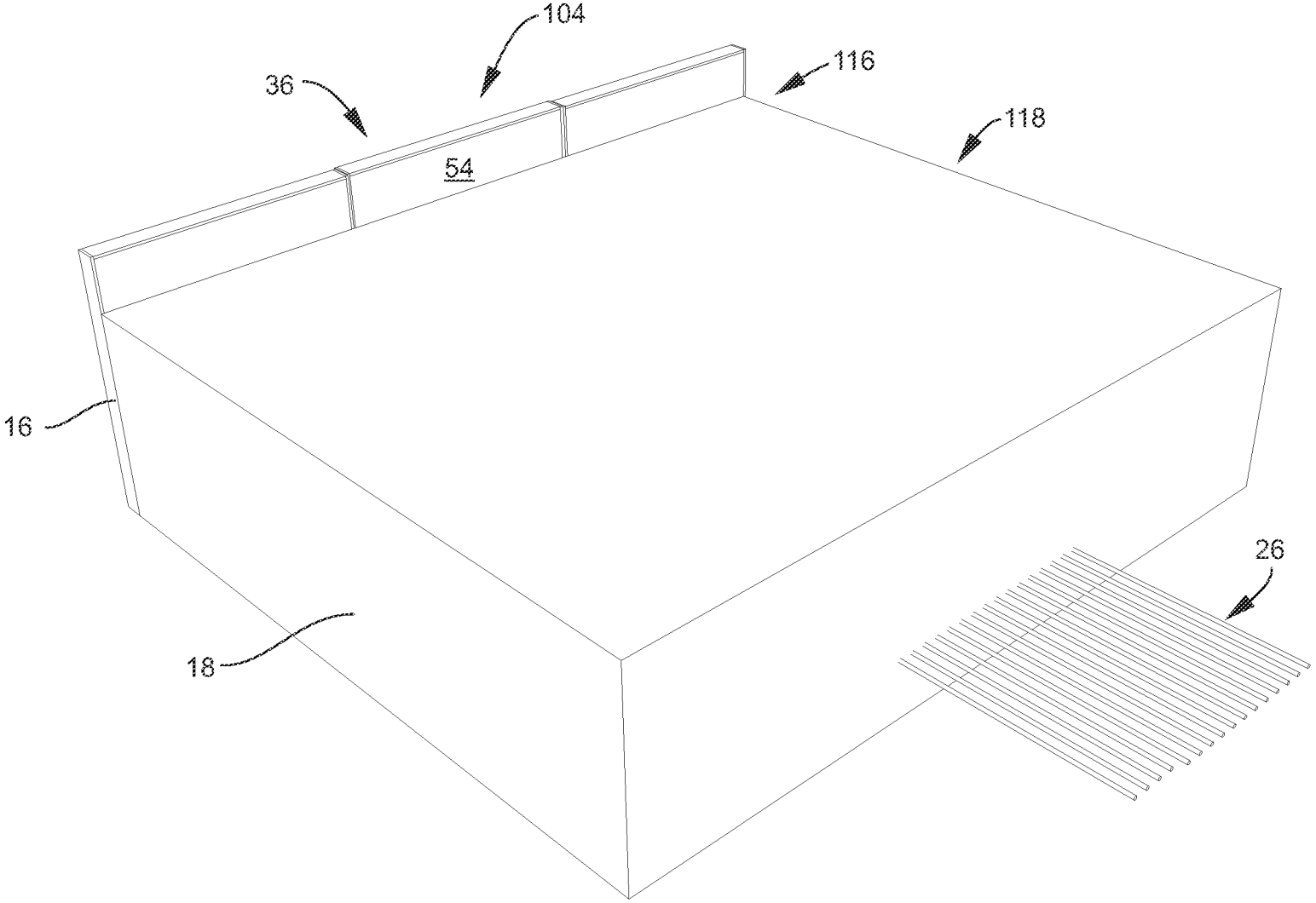
FIG. 15 is an inner perspective environmental view of select embodiments of pouring the concrete and waiting for the concrete to set according to select embodiments of the instant method of creating pockets in concrete for post-tension tendons.
Figure 16:
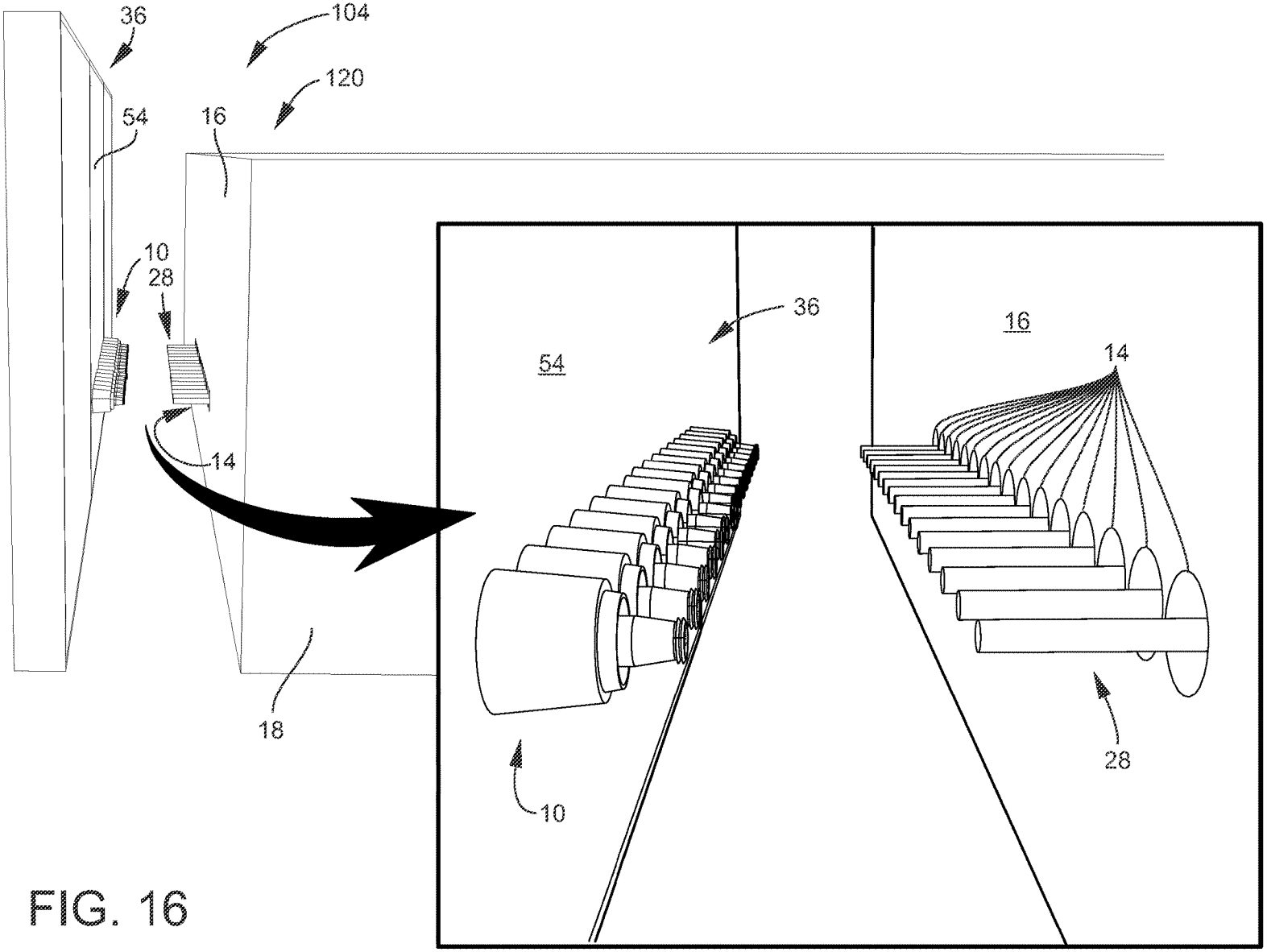
FIG. 16 is a side perspective environmental view of select embodiments of removing the formwork from the edge of the concrete, whereby, the post-tension pocket former remains attached to the formwork and pulls away from the anchor thereby creating the pocket in the edge of the concrete configured to allow tension to be applied to the tendon connected to the anchor according to select embodiments of the instant method of creating pockets in concrete for post-tension tendons.

Formwork securing mechanism 34 may be included with post-tension pocket former 10. Formwork securing mechanism 34 may be for securing second end 22 of pocket section 12 to inner surface 54. Formwork securing mechanism 34 may be designed and configured to tightly hold and secure post-tension pocket former 10 in hole 42 of formwork 36. Formwork securing mechanism 34 may include any devices, components, or means for securing second end 22 of pocket section 12 to inner surface 54. In select embodiments, formwork securing mechanism 34 may include alignment shaft 38 with formwork ribs 40. Alignment shaft 38 may be configured to align post-tension pocket former 10 in a desired orientation to inner surface 54 of formwork 36, including, but not limited to, perpendicular, as shown in the Figures. In select embodiments, alignment shaft 38 may extend completely through the middle of post-tension pocket former 10, as shown in the cross-section of FIG. 4. Formwork ribs 40 may be included on alignment shaft 38 to secure formwork securing mechanism inside hole 42 of formwork 36. Formwork ribs 40 may thus help to prevent back-outs of the post-tension pocket former, which typically occur with a nailed system. Additionally, when fasteners are used, post-tension pocket former 10 can still be installed with a single person, as the anchor 28 will at least be held in place on formwork 36 with formwork securing mechanism 34 while the fasteners are installed. Alignment shaft 38 with formwork ribs 40 may thus be configured to be inserted into hole 42 in formwork 36. In select embodiments, formwork ribs 40 on alignment shaft 38 of formwork securing mechanism 34 may be angled towards second end 22 of pocket section 12, as indicated with angles 44 best shown in FIGS. 3 and 4. Whereby, with angles 44 angled towards second end 22 of pocket section 12, formwork ribs 40 may be configured to prevent removal or backing out of alignment shaft 38 once inserted into hole 42 in formwork 36. In select embodiments, formwork ribs 40 on alignment shaft 38 of formwork securing mechanism 34 may be tapered, as indicated with tapers 46 best shown in FIGS. 3 and 4. Whereby, the formwork ribs 40 with tapers 46 may be designed and configured to slightly deflect during insertion of alignment shaft 38 into hole 42 in formwork 36. Alignment shaft 38 may have extended length 48 that extends from second end 22 of pocket section 12 to distal end 50. See FIGS. 3 and 4. In select embodiments, extended length 48 of alignment shaft 38 may be sized to extend at least thickness 52 of formwork 36 (thickness 52 best shown in FIGS. 7 and 11). Whereby, when alignment shaft 38 of formwork securing mechanism 34 is inserted through hole 42 in formwork 36 where second end 22 of pocket section 12 is aligned with inner surface 54 of formwork 36, distal end 50 of alignment shaft 38 and at least one of the formwork ribs 40 on alignment shaft 38 may extend beyond outer surface 55 of formwork 36, as best shown in FIG. 11. Extended length 48 of alignment shaft 38 may also enable alignment in different formwork thicknesses 52. Formwork securing mechanism 34 may be configured to secure second end 22 of pocket section 12 to any type of formwork 36, including, but not limited to, plywood formwork 56, medium-density fiberboard formwork 58, the like, and/or combinations thereof.

Anchor securing mechanism 60 may be included with post-tension pocket former 10. Anchor securing mechanism 60 may be for securing first end 20 of pocket section 12 to anchor 28. Anchor securing mechanism 60 may include any devices, components, or means for securing first end 20 of pocket section 12 to anchor 28.

Figure 3:
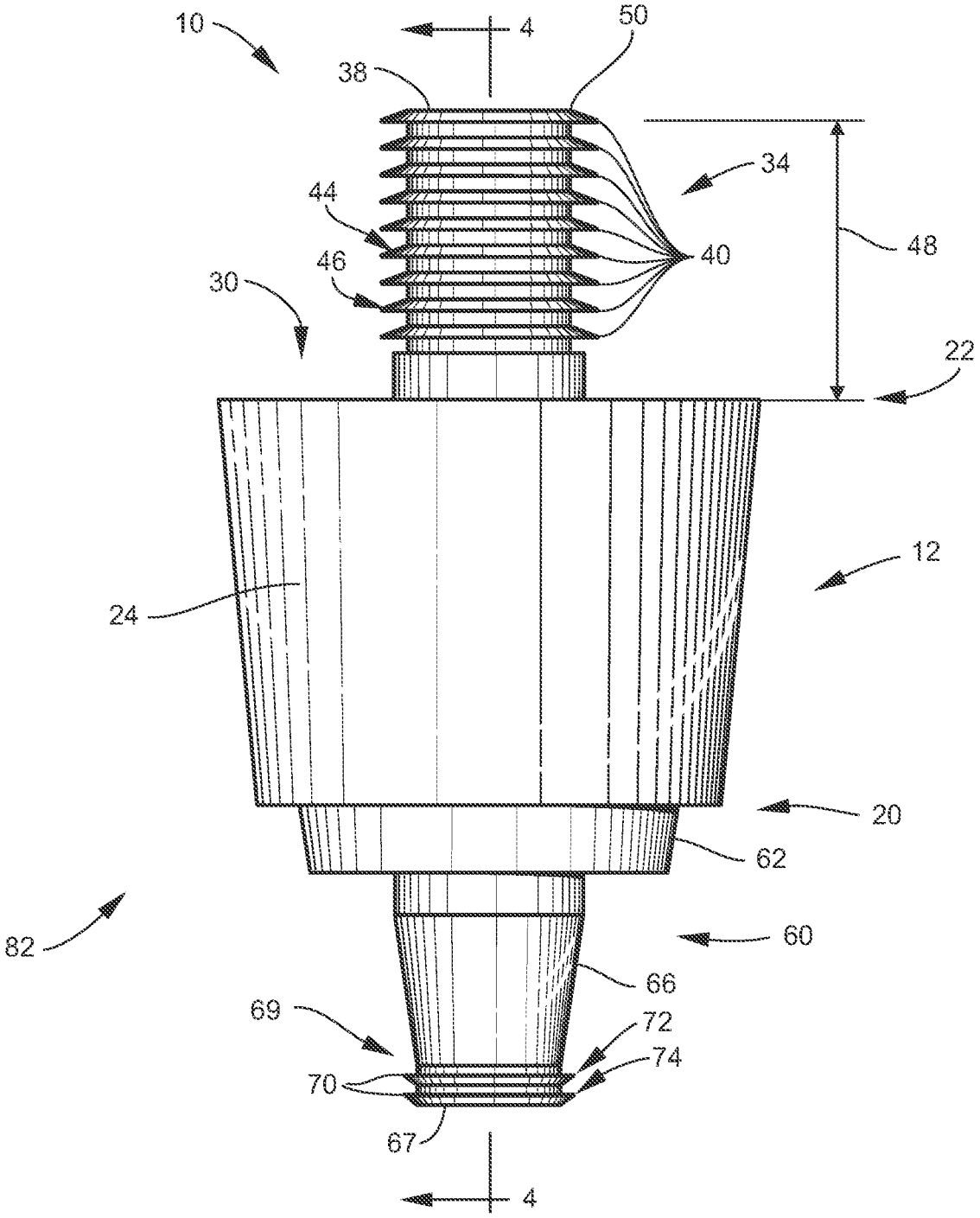
FIG. 3 is a side view of the post-tension tendon pocket former of FIG. 1.
Figure 4:
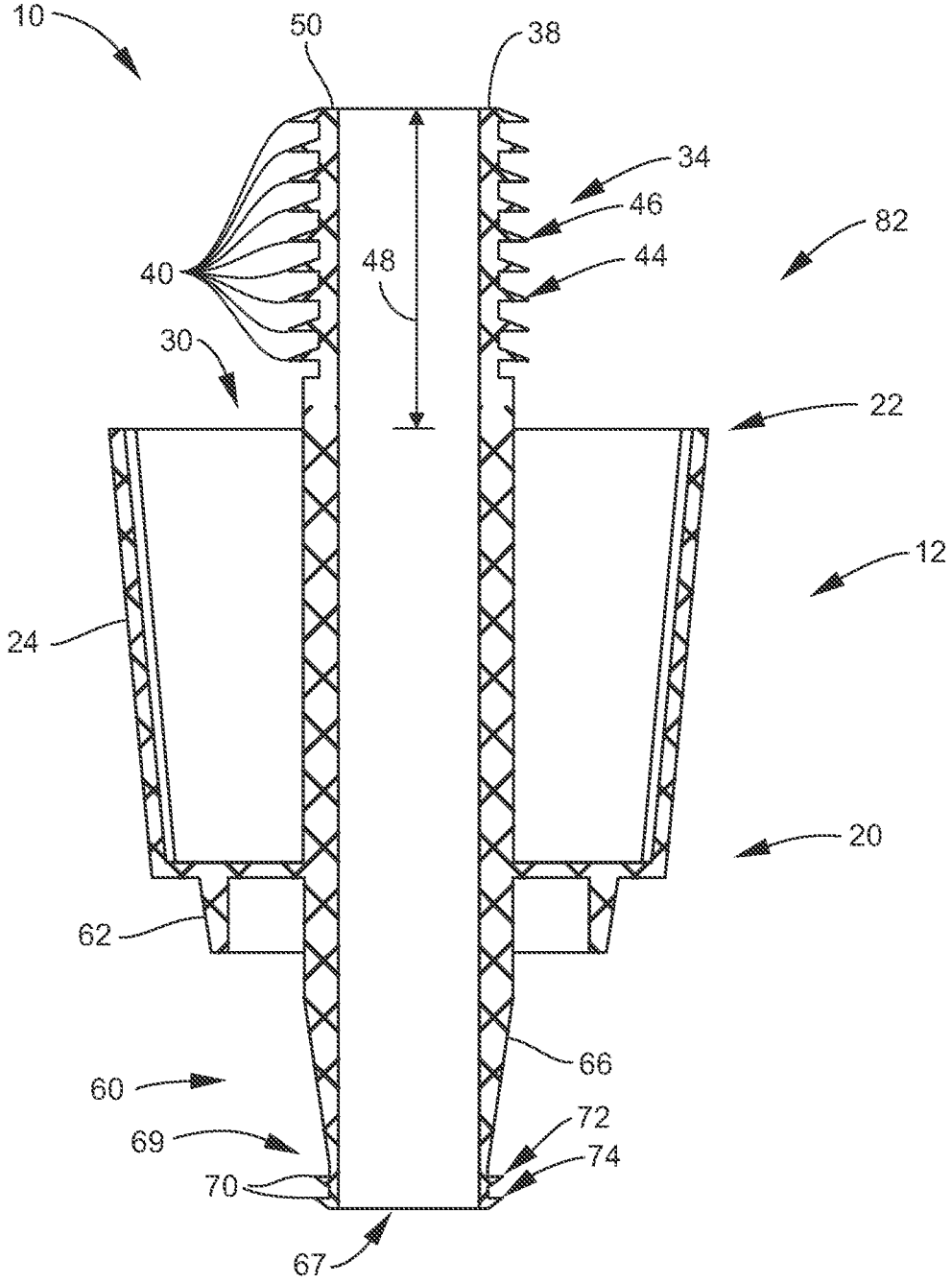
FIG. 4 is a cross-sectional view of the post-tension tendon pocket former of FIG. 1.
Figure 5:
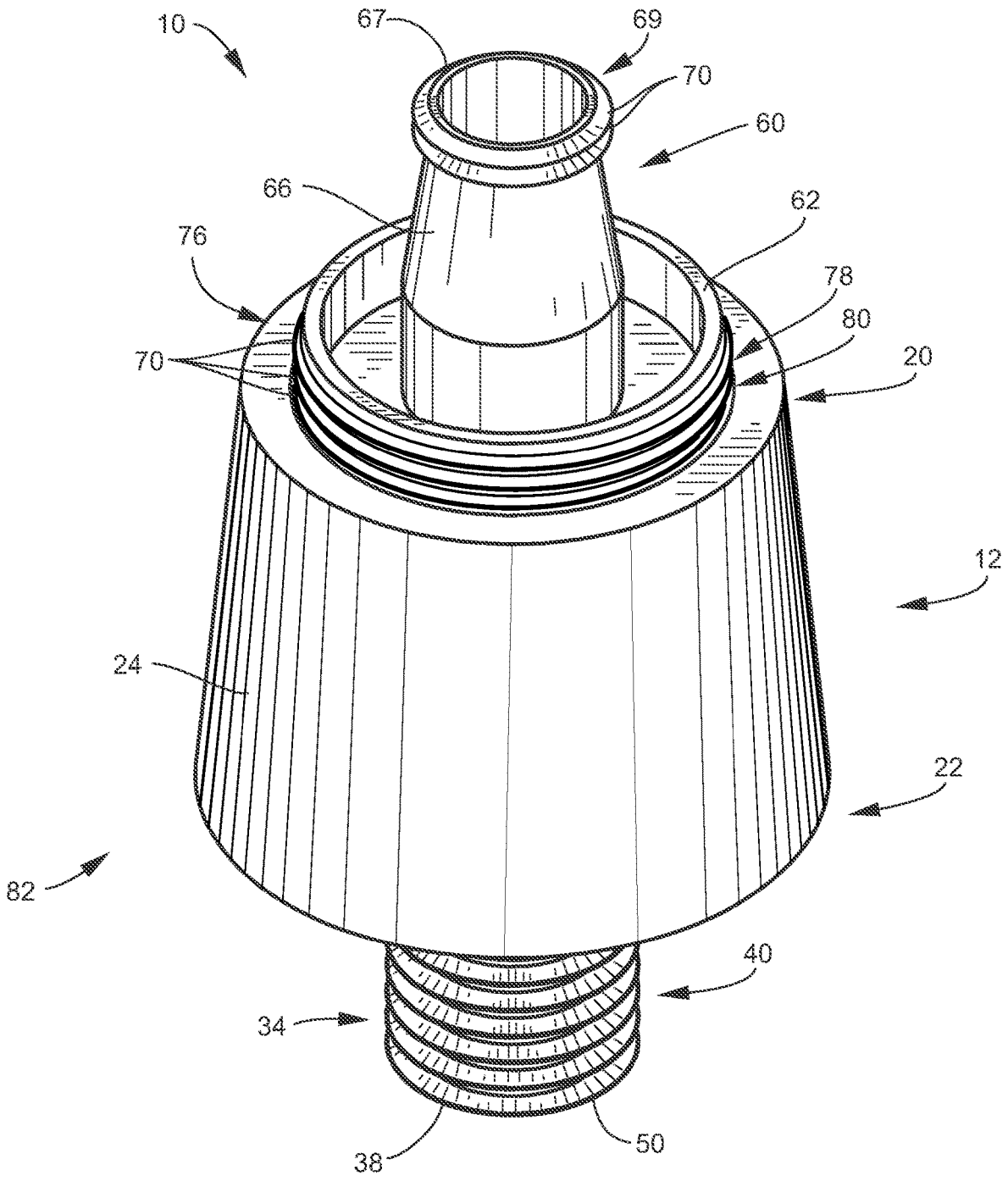
FIG. 5 is a perspective proximal end view of the post-tension tendon pocket former according to select embodiments of the instant disclosure with the first set of anchor ribs on the small tapered section and the second set of ribs on the slight tapered section.

In select embodiments, anchor securing mechanism 60 may include small tapered section 66. Small tapered section 66 may be for insertion into anchor 28 to prevent concrete intrusion. Small tapered section 66 may be configured and sized to fit tightly in the area where cable wedges would normally be installed in anchor 28. Small tapered section 66 may be connected to first end 20 of pocket section 12. Small tapered section 66 may be configured to be inserted into and secured in tapered receiver 68 of anchor 28. Small tapered section 66 may include first set 69 of anchor ribs 70 on proximal end 67 of small tapered section 66. In select embodiments, first set 69 of anchor ribs 70 of small tapered section 66 of anchor securing mechanism 60 may be angled towards first end 20 of pocket section 12, as indicated with reference number 72 in FIGS. 3 and 4. Whereby first set 69 of anchor ribs 70 are configured to prevent removal or backing out of small tapered section 66 from tapered receiver 68 of anchor 28. In other select embodiments, first set 69 of anchor ribs 70 may be tapered, as indicated with tapers 74 as shown in FIGS. 3 and 4. Whereby, first set 69 of anchor ribs 70 may be designed to slightly deflect during insertion of small tapered section 66 into tapered receiver 68 of anchor 28.

In other select embodiments, anchor securing mechanism 60 may include slight tapered section 62. Slight tapered sect ion 62 may ensure a tight seal to anchor 28 configured for preventing concrete 18 from getting to the surface of anchor 28. Slight tapered section 62 may be connected to first end 20 of pocket section 12. Slight tapered section 62 may be configured to seal to internal anchor assembly seal area 64 of anchor 28. Second set 76 of anchor ribs 70 may be included on the slight tapered section 62. See FIG. 5. In select embodiments, second set 76 of anchor ribs 70 of slight tapered section 62 of anchor securing mechanism 60 may be angled towards first end 20 of pocket section 12, as shown with angles 78 in FIG. 5. Whereby, second set 76 of anchor ribs 70 are configured to prevent removal or backing out of slight tapered section 62 from internal anchor assembly seal area 64 of anchor 28. In other select embodiments, second set 76 of anchor ribs 70 of slight tapered section 62 of anchor securing mechanism 60 may be tapered, as indicated with tapers 80 in FIG. 5. Whereby, second set 76 of anchor ribs 70 may be designed to slightly deflect during insertion of slight tapered section 62 into internal anchor assembly seal area 63 of anchor 28.

In yet another embodiment, anchor securing mechanism 60 may include slight tapered section 62 and small tapered section 66, as shown in the FIGS. Slight tapered section 62 may be connected to first end 20 of pocket section 12. Slight tapered section 62 may be configured to seal to internal anchor assembly seal area 64 of anchor 28, as discussed above. Slight tapered section 62 may be included with or without second set 76 of anchor ribs 70. Small tapered section 66 may be connected to slight tapered section 62. Small tapered section 66 may be configured to be inserted into and secured in tapered receiver 68 of anchor 28, as discussed above. In these embodiments, small tapered section may 66 be included with or without first set 69 of anchor ribs 70 on proximal end 67 of small tapered section 66.

Figure 17:
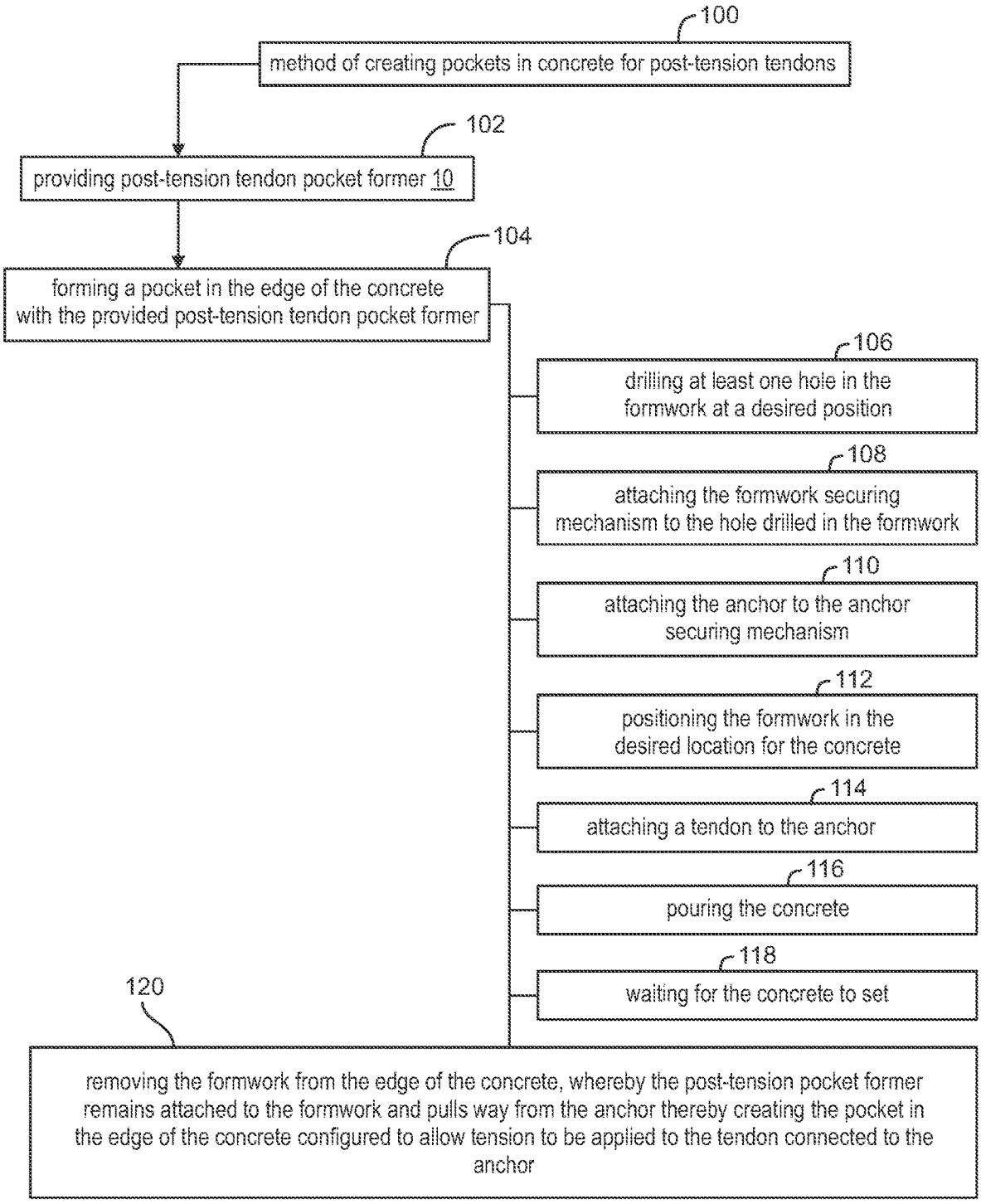
FIG. 17 is a flow diagram according to select embodiments of the instant method of creating pockets in concrete for post-tension tendons.

Referring now to FIG. 17, as supported by the environmental views of FIGS. 7-16, method 100 of creating pockets 14 in concrete 18 for post-tension tendons 26 is shown. Method 100 of creating pockets 14 in concrete 18 for post-tension tendons 26 generally may include step 102 of providing post-tension tendon pocket former 10 in any of the various embodiments shown and/or described herein. As such, the provided post-tension tendon pocket former 10 may generally include pocket section 12, formwork securing mechanism 34 and anchor securing mechanism 60. Pocket section 12 may be configured to create pocket 14 in edge 16 of concrete 18. Pocket section 12 may include first end 20 and second end 22. Formwork securing mechanism 34 may be connected to second end 22 of pocket section 12. Formwork securing mechanism 34 may be configured to secure second end 22 of pocket section 12 to formwork 36. Anchor securing mechanism 60 may be connected to first end 20 of pocket section 12. Anchor securing mechanism 60 may be configured to secure first end 20 of pocket section 12 to anchor 28. Wherein, using this provided post-tension pocket former 10, method 100 of creating pockets 14 in concrete 18 for post-tension tendons 26 may also include step 104 of forming pocket 13 in edge 16 of concrete 18 with the provided post-tension tendon pocket former 10. Method 100 of creating pockets 14 in concrete 18 for post-tension tendons 26 may include any additional steps or methods whether common, known, or discovered in the future for creating pockets 14 in concrete 18 for post-tension tendons 26. In select embodiments of method 100 of installing post-tension tendons 26 in concrete 18, step 104 of forming pocket 14 in edge 16 of concrete 18 with the provided post-tension tendon pocket former 10 may also include: step 106 of drilling at least one hole 42 in formwork 36 at desired position 43 (see FIG. 8); step 108 of attaching formwork securing mechanism 34 to hole 42 drilled in formwork 36 (see FIG. 9); step 110 of attaching anchor 28 to anchor securing mechanism 60 (see FIG. 9); step 112 of positioning formwork 36 in desired location for concrete 18 (see FIGS. 10-12); step 114 of attaching tendon 26 to anchor 28 (see FIG. 13); step 116 of pouring concrete 18 (see FIG. 15); step 118 of waiting for concrete 18 to set (see FIG. 15); and step 120 of removing formwork 36 from edge 16 of concrete 18 (see FIG. 16). Whereby, post-tension pocket former 10 may remain attached to formwork 36 and pulls away from edge 16 and concrete 18 with anchor 28 positioned therein, thereby, creating pocket 14 in edge 16 of concrete 18 configured to allow: tension to be applied to tendon 26 connected to anchor 28, tendon 26 to be cut, grease cap/corrosion protection installed, grout applied, the like, etc. (see FIG. 16). However, the order of the steps or processes of method 100 of creating pockets 14 in concrete 18 for post-tension tendons 26 are not so limited to the order shown and/or described herein and various other orders or embodiments can be used (i.e. formwork 36 can be placed before holes 42 are drilled).

In sum, post-tension tendon pocket former 10 may be included with ribbed formwork securing mechanism 34. Post-tension tendon pocket former 10 thus uses a one piece pocket former 82 that secures, and aligns anchor 28 in one step to plywood formwork 56, or the like. The use of post-tension pocket former 10 may make it easy for a single man installation in a fraction of the time. Formwork ribs 40 may help to prevent backout, that typically may occur with a nailed system. Additionally, if fasteners are going to be used it is still a one man job as anchor 28 can be held in place with post-tension pocket former 10 while the fasteners are installed. This clearly provides an improvement and advantage of current pocket formers for post tension cables, which only provide a small alignment ring for the anchor to plywood connection. This requires the user to hold the anchor in alignment and secure it using nails or screws. Holding the anchor, nail and a hammer is difficult in open situations but even harder in tight spaces, such as beams and columns with rebar. Holding the anchor, nail, and hammer using one person is very difficult. When the area has rebar the installation may require the use of a "pea shooter" to install the nails. The typical installation would require two people. Others have used a threaded mandrel and nut that secures the anchor to the plywood formwork, but this still requires two people in areas where the opposing side of the formwork is not easily accessible. The mandrel approach also requires multiple pieces which makes it cumbersome.

As such, unlike the instant post-tension pocket former 10, currently all of the known one-piece pocket formers and anchor assemblies require nails or screws to hold the assembly in place during tendon installation and concrete placement. The installation of nails into the plywood is difficult because of rigidity, and having to hold everything at one time. Screws may make this easier, but can make removal of the forms difficult. Both screws and nails are difficult to install and require extensions and creative methods when rebar is installed before the tendons are installed.

The disclosure of the instant post-tension tendon pocket former 10 may utilize angled directional formwork ribs 40 to allow the pocket former to penetrate hole 42 in plywood formwork 56 (or the like), and prevent easy pullout. This eliminates the need for nails, screws, or opposing nuts. It makes alignment easier and holds the assembly in place allowing for use with and without fasteners. In addition the pocket former is secured to anchor 28 using anchor ribs 70 to keep the assembly together. The disclosed pocket former 10 may thus differ from what currently exists, as the only other "fastener-less" solutions on the market use a threaded plastic mandrel and nut. This increases the number of loose pieces that need to be organized on the job. It also requires access to the opposing side of the form work (outer surface 55), which is difficult and dangerous and sometimes impossible in many instances with beams and columns.

The inverted formwork ribs 40 and anchor ribs 70 may be the basis of the disclosure as they are used to secure post-tension tendon pocket former 10 to formwork 36 and likewise to anchor assembly 28. The increased length of alignment shaft 38 is provided to penetrate plywood formwork 56 (or the like) and increase the grip. Large tapered section 24 can be designed, sized or adjusted to suit the needs of the job while leaving the main attaching components alone.

In use, a user would take a commercially available tendon anchor 28, and insert the ribbed small tapered section into the anchor assembly. They would use pressure and a twisting motion to increase the gripping force. After determining the desired location for the anchor 28 in formwork 36 and drilling the proper size of hole 42, a twisting and pushing motion will seat the formwork securing mechanism of pocket former 10 with the anchor assembly into plywood formwork 56, or the like. The user would then apply fasteners if determined necessary. Next, rebar could be applied behind anchor 28 to increase load spread under tension, which will also help to hold anchors 28 in place.

In the specification and/or figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein but is limited only by the following claims.

The invention claimed is:

1. A post-tension tendon pocket former comprising:

a pocket section configured to create a pocket in an edge of concrete, said pocket section including a first end, and a second end;

a formwork securing mechanism connected to the second end of the pocket section, said formwork securing mechanism is configured to secure the second end of the pocket section to a formwork; and an anchor securing mechanism connected to the first end of the pocket section, said anchor securing mechanism is configured to secure the first end of the pocket section to a post-tension tendon anchor;

wherein the pocket section, the formwork securing mechanism, and the anchor securing mechanism of the post-tension tendon pocket former are integrally formed to create a one-piece pocket former.

2. The post-tension tendon pocket former of claim 1, whereby the post-tension tendon pocket former is configured so secure and align the anchor to the formwork.

3. The post-tension tendon pocket former of claim 1, wherein the formwork securing mechanism includes:

an alignment shaft with formwork ribs configured to be inserted into a hole in the formwork.

4. The post-tension tendon pocket former of claim 3, wherein the formwork ribs on the alignment shaft of the formwork securing mechanism are angled towards the second end of the pocket section, whereby the formwork ribs are configured to prevent removal or backing out of the alignment shaft once inserted into the hole in the formwork.

5. The post-tension tendon pocket former of claim 3, wherein the formwork ribs on the alignment shaft of the formwork securing mechanism are tapered, whereby, the formwork ribs are configured to slightly deflect during insertion of the alignment shaft into the hole in the formwork;

whereby, the post-tension pocket former is configured to create the pocket in the edge of the concrete when the formwork is removed from the edge of the concrete, where the formwork ribs of the post-tension pocket former are configured to secure the post-tension tendon pocket former to the hole in the formwork, thereby, removing the post-tension tendon pocket former away from the edge of the concrete with the formwork for creating the pocket in the edge of the concrete.

6. The post-tension tendon pocket former of claim 3, wherein the alignment shaft has an extended length that extends from the second end of the pocket section to a distal end, where the extended length is sized to extend at least a thickness of the formwork, whereby when the alignment shaft of the formwork securing mechanism is inserted through the hole in the formwork where the second end of the pocket section is aligned with an inner surface of the formwork, the distal end of the alignment shaft and at least one of the formwork ribs on the alignment shaft extend beyond an outer surface of the formwork.

7. The post-tension tendon pocket former of claim 1, wherein the formwork securing mechanism is configured to secure the second end of the pocket section to a plywood formwork or a medium-density fiberboard formwork.

8. The post-tension tendon pocket former of claim 1, wherein the anchor securing mechanism includes:

a small tapered section connected to the first end of the pocket section configured to be inserted into and secured within a tapered receiver of the anchor; and a first set of anchor ribs on a proximal end of the small tapered section.

9. The post-tension tendon pocket former of claim 8, wherein the first set of the anchor ribs of the small tapered section of the anchor securing mechanism are:

angled towards the first end of the pocket section, whereby the first set of the anchor ribs are configured to prevent removal or backing out of the small tapered section from the tapered receiver of the anchor;

tapered, whereby, the first set of the anchor ribs slightly deflect during insertion of the small tapered section into the tapered receiver of the anchor; or combinations thereof.

10. The post-tension tendon pocket former of claim 1, wherein the anchor securing mechanism includes:

a slight tapered section connected to the first end of the pocket section configured to seal to an internal anchor assembly seal area of the anchor; and a second set of anchor ribs on the slight tapered section.

11. The post-tension tendon pocket former of claim 10, wherein the second set of the anchor ribs of the slight tapered section of the anchor securing mechanism are:

angled towards the first end of the pocket section, whereby the second set of the anchor ribs are configured to prevent removal or backing out of the slight tapered section from the internal anchor assembly seal area of the anchor;

tapered, whereby, the second set of the anchor ribs slightly deflect during insertion of the slight tapered section into the internal anchor assembly seal area of the anchor; or combinations thereof.

12. The post-tension tendon pocket former of claim 1, wherein the anchor securing mechanism includes:

a slight tapered section connected to the first end of the pocket section configured to seal to an internal anchor assembly seal area of the anchor;

a small tapered section connected to the slight tapered section configured to be inserted into and secured within a tapered receiver of the anchor;

a first set of anchor ribs on a proximal end of the small tapered section; and a second set of the anchor ribs on the slight tapered section.

13. The post-tension tendon pocket former of claim 12, wherein:

the first set of the anchor ribs on the proximal end of the small tapered section of the anchor securing mechanism are:

angled towards the first end of the pocket section, whereby the first set of the anchor ribs are configured to prevent removal or backing out of the small tapered section from the tapered receiver of the anchor; and tapered, whereby, the first set of the anchor ribs slightly deflect during insertion of the small tapered section into the tapered receiver of the anchor; and the second set of the anchor ribs of the slight tapered section of the anchor securing mechanism are:

angled towards the first end of the pocket section, whereby the second set of the anchor ribs are configured to prevent removal or backing out of the slight tapered section from the internal anchor assembly seal area of the anchor; and tapered, whereby, the second set of the anchor ribs slightly deflect during insertion of the slight tapered section into the internal anchor assembly seal area of the anchor.

14. The post-tension tendon pocket former of claim 1, wherein the pocket section has a large tapered section between the first end and the second end configured to create the pocket in the edge of the concrete configured to allow tension to be applied to a tendon connected to the anchor.

15. The post-tension tendon pocket former of claim 14, wherein the large tapered section of the pocket section includes a hollow interior supported by a plurality of spokes.

16. The post-tension tendon pocket former of claim 15, wherein the hollow interior of the large tapered section of the pocket section includes five spokes for supporting the hollow interior.

17. A post-tension tendon pocket former comprising:

a pocket section configured to create a pocket in an edge of concrete, said pocket section including a first end, and a second end, the pocket section has a large tapered section between said first end and said second end configured to create the pocket in the edge of the concrete, where the pocket is configured to allow tension to be applied to a tendon connected to a post-tension tendon anchor, wherein the large tapered section of the pocket section includes a hollow interior supported by a plurality of spokes;

a formwork securing mechanism connected to the second end of the pocket section, said formwork securing mechanism is configured to secure the second end of the pocket section to a formwork, wherein the formwork securing mechanism includes:

an alignment shaft with formwork ribs configured to be inserted into a hole in the formwork, the formwork ribs on the alignment shaft of the formwork securing mechanism are angled towards the second end of the pocket section, whereby the formwork ribs are configured to prevent removal or backing out of the alignment shaft once inserted into the hole in the formwork;

the formwork ribs on the alignment shaft of the plywood are tapered, whereby, the formwork ribs slightly deflect during insertion of the alignment shaft into the hole in the formwork, whereby, the post-tension pocket former is configured to create the pocket in the edge of the concrete when the formwork is removed from the edge of the concrete, where the formwork ribs of the post-tension pocket former are configured to secure the post-tension tendon pocket former to the hole in the formwork, thereby, removing the post-tension tendon pocket former away from the edge of the concrete with the formwork for creating the pocket in the edge of the concrete;

the alignment shaft has an extended length that extends from the second end of the pocket section to a distal end, where the extended length is sized to extend at least a thickness of the formwork, whereby when the alignment shaft of the formwork securing mechanism is inserted through the hole in the formwork where the second end of the pocket section is aligned with an inner surface of the formwork, the distal end of the alignment shaft and at least one of the formwork ribs on the alignment shaft extend beyond an outer surface of the formwork;

wherein the formwork securing mechanism is configured to secure the second end of the pocket section to a plywood formwork or a medium-density fiberboard formwork;

an anchor securing mechanism connected to the first end of the pocket section, said anchor securing mechanism is configured to secure the first end of the pocket section to the anchor, wherein the anchor securing mechanism includes:

a slight tapered section connected to the first end of the pocket section configured to seal to an internal anchor assembly seal area of the anchor;

a small tapered section connected to the slight tapered section configured to be inserted into and secured within a tapered receiver of the anchor;

a first set of anchor ribs on a proximal end of the small tapered section, the first set of the anchor ribs of the small tapered section of the anchor securing mechanism are:

angled towards the first end of the pocket section, whereby the first set of the anchor ribs are configured to prevent removal or backing out of the small tapered section from the tapered receiver of the anchor; and tapered, whereby, the first set of the anchor ribs slightly deflect during insertion of the small tapered section into the tapered receiver of the anchor; and a second set of the anchor ribs on the slight tapered section, the second set of the anchor ribs of the slight tapered section of the anchor securing mechanism are:

angled towards the first end of the pocket section, whereby the second set of the anchor ribs are configured to prevent removal or backing out of the slight tapered section from the internal anchor assembly seal area of the anchor; and tapered, whereby, the second set of the anchor ribs slightly deflect during insertion of the slight tapered section into the internal anchor assembly seal area of the anchor;

wherein the pocket section, the formwork securing mechanism, and the anchor securing mechanism of the post-tension tendon pocket former are integrally formed to create a one-piece pocket former;

whereby the post-tension tendon pocket former is configured so secure and align the to the formwork.

* * * * *